US011208313B2

(12) United States Patent
Conover et al.

(10) Patent No.: US 11,208,313 B2
(45) Date of Patent: Dec. 28, 2021

(54) METHODS AND APPARATUS FOR POST-MIX DRINK DISPENSING

(71) Applicant: Lancer Corporation, San Antonio, TX (US)

(72) Inventors: Darryl E. Conover, Huntington Beach, CA (US); Brandon P. Ojeda, San Antonio, TX (US); Merrill R. Good, San Antonio, TX (US)

(73) Assignee: Lancer Corporation, San Antonio, TX (US)

( * ) Notice: Subject to any disclaimer, the term of this patent is extended or adjusted under 35 U.S.C. 154(b) by 51 days.

(21) Appl. No.: 16/394,889

(22) Filed: Apr. 25, 2019

(65) Prior Publication Data

US 2019/0330044 A1 Oct. 31, 2019

Related U.S. Application Data

(60) Provisional application No. 62/662,856, filed on Apr. 26, 2018.

(51) Int. Cl.
*B67D 1/00* (2006.01)

(52) U.S. Cl.
CPC ..... *B67D 1/0052* (2013.01); *B67D 1/0021* (2013.01)

(58) Field of Classification Search
CPC .... B67D 1/0044; B67D 1/005; B67D 1/0021; B67D 1/0052; B67D 1/0048; B67D 1/004; B67D 1/0051; B67D 1/0082; B67D 1/0888
USPC ..... 222/129.1, 145.5, 145.1, 459, 1
See application file for complete search history.

(56) References Cited

U.S. PATENT DOCUMENTS 2,819,824 A 1/1958 Ebert
4,218,014 A * 8/1980 Tracy ..... B05B 7/0408 222/144.5
4,747,692 A * 5/1988 Harrison ..... B67D 1/0047 222/129.1
5,048,726 A * 9/1991 McCann ..... B67D 1/0044 222/129.1

(Continued)

FOREIGN PATENT DOCUMENTS

WO 2014200481 A1 12/2014

OTHER PUBLICATIONS

International Search Report and Written Opinion for PCT/US19/29178, which is counterpart to U.S. Appl. No. 16/394,889.

*Primary Examiner* — Charles P. Cheyney
(74) *Attorney, Agent, or Firm* — Christopher L. Makay

(57) ABSTRACT

A post-mix drink dispenser includes a mixer body securable to a drink dispensing system and having at least one beverage concentrate inlet and outlet sheltered within a downwardly open cavity in the bottom thereof; a diluent channel formed exterior to the cavity and about a lower sidewall of the mixer body; and a nozzle housing securable in place about the mixer body. The dispenser includes an air channel formed in a wall portion of the nozzle housing, a diffuser to organize flows of diluent along the interior surface of the nozzle housing, or both a vent and a diffuser. The air channel includes provisions to impede ingress of diluent, and to contain flow through the channel of liquid beverage components. The diffuser may be formed unitary with the nozzle housing, or may be selectively removable from the drink dispenser.

47 Claims, 13 Drawing Sheets

(56) References Cited

U.S. PATENT DOCUMENTS 5,415,326 A * 5/1995 Durham ..... B67D 1/005 222/129.1
5,575,405 A * 11/1996 Stratton ..... B67D 1/0021 222/1
5,649,644 A 7/1997 Hashimoto et al.
6,253,963 B1 7/2001 Tachibana
6,305,269 B1 * 10/2001 Stratton ..... B67D 1/0044 222/459
6,845,885 B2 1/2005 Moregenroth
6,983,863 B2 1/2006 Santy, Jr.
7,036,687 B1 * 5/2006 Lowe ..... A47J 31/401 222/129.1
7,111,759 B1 * 9/2006 Gorski ..... B67D 1/0021 222/145.6
7,487,887 B2 2/2009 Ziesel
9,656,849 B2 5/2017 Hawken
10,351,409 B2 7/2019 Smeller et al.
2004/0099688 A1 * 5/2004 Davis ..... B67D 1/0037 222/145.1
2005/0045655 A1 3/2005 Santy, Jr.
2005/0115989 A1 * 6/2005 Ludovissie ..... B67D 1/005 222/145.5
2006/0151051 A1 * 7/2006 Py ..... B67D 1/108 141/67
2006/0289563 A1 * 12/2006 Ziesel ..... B67D 1/0052 222/145.1
2009/0230149 A1 9/2009 Smeller et al.
2011/0305807 A1 * 12/2011 Koeling ..... A47J 31/407 426/431
2017/0190554 A1 7/2017 Dahlberg et al.
2017/0233234 A1 8/2017 Hecht et al.
2018/0282143 A1 * 10/2018 Chang ..... A23L 2/76
2018/0327245 A1 * 11/2018 Ziesel ..... B67D 1/0022
2019/0039873 A1 2/2019 Aslam et al.

* cited by examiner

METHODS AND APPARATUS FOR POST-MIX DRINK DISPENSING

BACKGROUND OF THE INVENTION

1. Field of the Invention

The present invention relates to post-mix drink dispensing, and, more particularly, but not by way of limitation, to post-mix drink dispensing systems that combine one or more concentrate with a diluent such as carbonated water or plain water and then dispenses the combined one or more concentrate and diluent.

2. Description of the Related Art

In order to conserve valuable retail space, it is desirable to implement and use a multiple flavor post-mix drink dispenser capable of selectively dispensing any drink including any one or more concentrate and a diluent, such as carbonated water or plain water. Obstacles to using multiple flavor post-mix drink dispensers, however, include: the retaining of pungent flavors through permeation of component parts of the multiple flavor post-mix drink dispenser, accounting for the different physical properties in carbonated and plain water so as to provide a smooth stream of fluid; and the splashing of fluids and syrups on the user when dispensing.

A problem inherent in drink dispensing systems using multiple flavor post-mix drink dispensers is cross-contamination/color carry-over. This occurs when a dark colored beverage is dispensed prior to a light colored beverage. Residual amounts of the dark beverage may remain in an area common to both beverage delivery routes or areas in proximity to the dispensing route of the light beverage. When the light beverage is dispensed, the residual amounts of the dark beverage will mix with the light beverage, causing a discoloration and possibly a flavor alteration of the light colored beverage.

Another drawback of current beverage dispensing devices using multiple flavor beverage post-mix drink dispensers is the difficulty of delivering a "flavor shot." A flavor shot, which is a small amount of concentrated flavor syrup, such as lemon flavoring for hot or iced tea, is generally dispensed after dispensing the base drink and without combining with a mixing fluid. For the same reasons as previously mentioned, but exacerbated by the possible absence of a diluent, such delivery of a flavor shot is difficult to accomplish without affecting the color or taste of beverages to be dispensed after the flavor shot.

Complicating this persistent problem still further, Applicant has discovered that coloring may occur even where a post-mix drink dispenser is otherwise carefully designed to avoid flows of concentrates or additives into contact with surfaces not susceptible to "washing" by subsequent flow of a diluent. In particular, Applicant has discovered that, especially with plain water as the diluent, air pockets surrounding such surfaces form an air bubble trapped within the nozzle housing of the post-mix drink dispenser, causing the trapped air to be pulled through and out the outlet of the nozzle housing by and with the flow of dispensing beverages. As the air bubble diminishes, it is replaced by the dispensing beverage, causing the included concentrates and additives to cling to surfaces that otherwise would have been clear of flows. Still further, upon completion of the pour cycle, pressure within the nozzle housing will equalize, which then allows the trapped liquid to drip or drop from the post-mix drink dispenser.

Additionally, Applicant has discovered that plain water, when used as the diluent, is susceptible to separation into multiple flow paths as the plain water transits the nozzle housing. These separate flows come back together as the beverage approaches the narrowed outlet from the nozzle housing, where the collision of the non-uniform flows causes a random "fan" and "twist" effect. Rather than flowing from the nozzle housing in a consistent column shape, the dispensed beverage can splash syrups and other fluids on the user, as opposed to being restricted to flowing through the open top of a beverage cup or into a drip tray of the drink dispensing system.

Accordingly, a post-mix drink dispenser suitable to dispense one or more concentrate with a diluent, where the diluent may be selected without compromise from carbonated or plain water, will meet new demands in the drink dispensing industry.

SUMMARY OF THE INVENTION

In accordance with the present invention, a post-mix drink dispenser generally comprises a mixer body securable to a drink dispensing system and having at least one beverage concentrate inlet corresponding beverage concentrate outlet, where each provided beverage concentrate outlet is sheltered within a downwardly open cavity formed in the bottom of the mixer body, which is bounded by an interior portion of a lower sidewall of the mixer body; a diluent pathway running through a diluent channel formed exterior to the cavity and about the lower sidewall; and a nozzle housing, comprising a walled body, securable in place about the mixer body, and having a substantially open interior and an outlet formed at the bottom, whereby the nozzle housing is adapted to coalesce beverage components flowing from the mixer body and diluent flowing about the mixer body and direct the coalesced beverage components and diluent through the outlet from the housing.

In accordance with a first implementation of the present invention, the post-mix drink dispenser also comprises a vent formed in a wall portion of the nozzle housing, is adapted to provide air from without the nozzle housing to the cavity in the bottom of the mixer body as coalesced beverage components and diluent flow through the outlet from the nozzle housing. In accordance with a second implementation of the present invention, the post-mix drink dispenser also comprises a diffuser adapted to organize flows of diluent along the interior surface of the nozzle housing into multiple substantially uniform individual flows. Still further, and in accordance with a third implementation of the present invention, the post-mix drink dispenser also comprises both a vent and a diffuser.

In any implementation of the post-mix drink dispenser, each beverage concentrate outlet may comprise a beverage concentrate nozzle, which may be directional, and the mixer body may have a plurality of beverage concentrate inlets. Likewise, the mixer body may have one of more beverage additive inlet, and corresponding beverage additive outlets, which may comprise nozzles or directional nozzles. Additionally, the mixer body and nozzle housing may be cooperatively adapted to form the diluent channel, and the mixer body may comprise one or more diluent inlets where each diluent inlet is in fluid communication with a diluent outlet flowing into the diluent channel. Still further, in any implementation of the post-mix drink dispenser the mixer body may be formed as a multi-body assembly and/or the nozzle housing may be securable to the mixer body.

In at least some preferred implementations of the post-mix drink dispenser comprising a vent, the vent comprises an air channel through the wall portion having an air inlet and an air outlet. In such implementations, the air outlet projects from the wall portion to terminate at a location within the interior space of the nozzle housing that is within the horizontal extents of the interior portion of the lower sidewall of the mixer body. Most preferably, the air channel is adapted to impede ingress to the air outlet of diluent, and to this end may comprise a wall formed about the air outlet. Also, most preferably, the air channel is adapted to contain flow through the vent of liquid beverage components, such as may happen if the outlet from the nozzle becomes inadvertently or otherwise as a drink is being dispensed. To this end, the air inlet is most preferably located at the bottom of nozzle housing adjacent the outlet and is oriented to direct any liquid beverage component flowing out of the inlet downward and toward a central vertical axis running through the outlet of the nozzle housing.

In at least some implementations of the post-mix drink dispenser comprising a diffuser, the diffuser is formed unitary with the nozzle housing, such as, for example, by the provision radially about the interior surface of the nozzle housing of a plurality of vertically oriented fins. In at least some other implementations of the post-mix drink dispenser comprising a diffuser, the diffuser is selectively removable from the post-mix drink dispenser, and, in use, the diffuser may be dependently supported in place with respect to the mixer body by the nozzle housing. Such a selectively removable diffuser may comprise an annular wall having an inner surface defining a central orifice, an outer surface, a top edge, and a bottom edge; a circumferential foot about the outer surface of the annular wall and adjacent the bottom edge of the annular wall; and a plurality of flow passages provided through and about said circumferential foot. In the most preferred implementations of the exemplary selectively removable diffuser, the top edge of the annular wall is interiorly chamfered, the bottom edge of the annular wall is interiorly filleted, each flow passage through the circumferential foot has a semicircular cross section, and the outer face of the annular wall is undercut adjacent the circumferential foot to maximize flow.

In accordance with the present invention, a method for dispensing a post-mix drink comprises the steps of flowing a quantity of beverage concentrate from a concentrate outlet sheltered within a cavity at the bottom of a mixing body; flowing a quantity of diluent about the mixing body and external to the cavity; coalescing the beverage concentrate and diluent within a nozzle housing provided about the mixing body; and maintaining an air pocket about the concentrate outlet as coalesced beverage products flow through a nozzle outlet of the nozzle housing. In at least some implementations of the present invention, the air pocket is maintained by equalizing the pressure of the air pocket with the ambient pressure external to the nozzle housing, such as, for example, by providing a vent through the nozzle housing. Additionally, any implementation of the method for dispensing a post-mix drink may further comprises the step of diffusing the quantity of diluent into multiple substantially uniform individual flows.

DETAILED DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. Figures are not necessarily to scale, and some features may be exaggerated to show details of particular components or steps.

Figure 1:
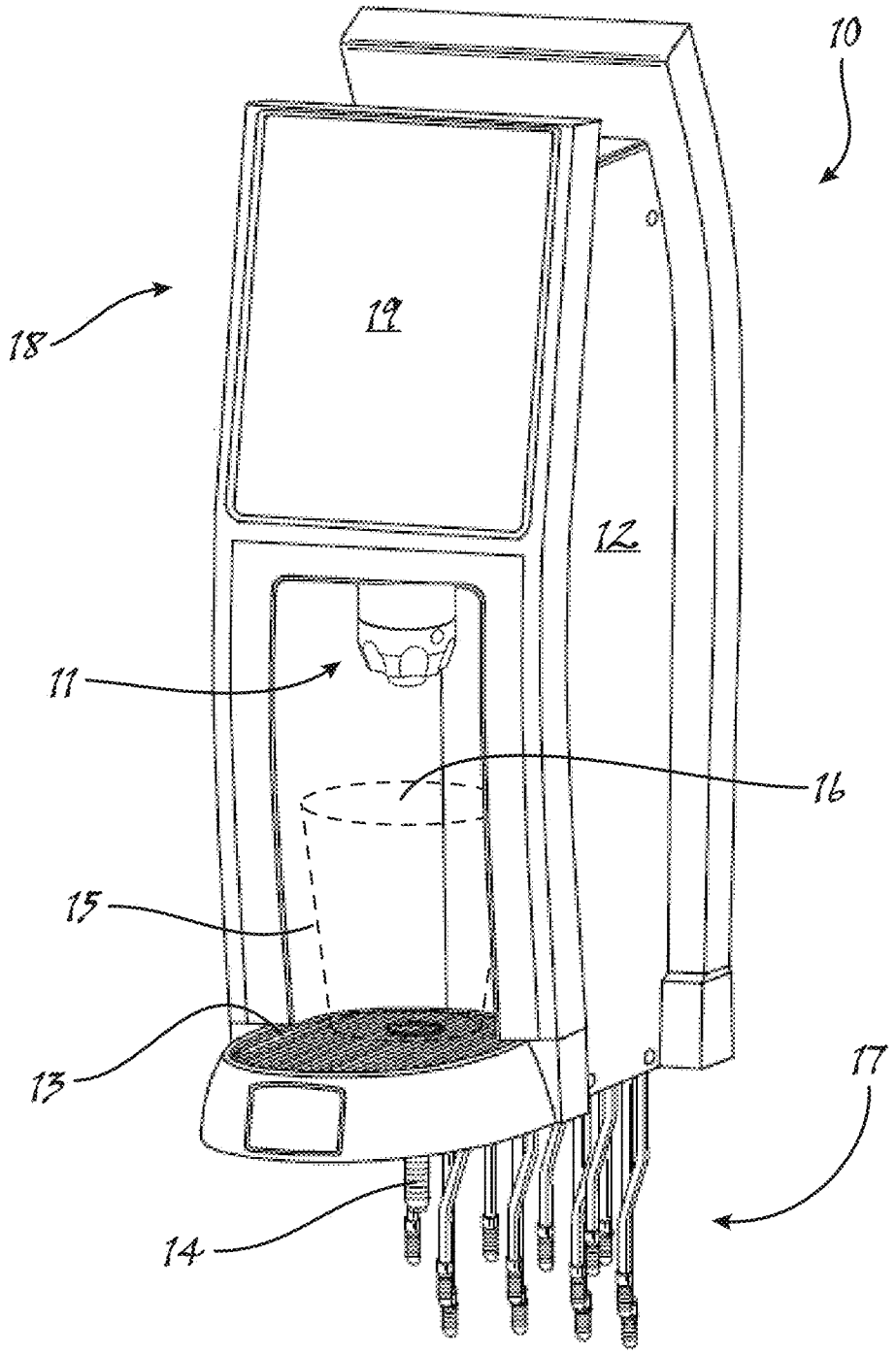
FIG. 1 is an isometric view illustrating a post-mix drink dispenser according to a first embodiment incorporated into an example drink dispensing system.

FIG. 1 illustrates a post-mix drink dispenser 11 according to a first embodiment of the present invention, and as incorporated into an example drink dispensing system 10. Once incorporated into the drink dispensing system 10, the post-mix drink dispenser 11 provides the drink dispensing system 10 with the capability to dispense one or more concentrate with a diluent, where the diluent may be selected from carbonated water or plain water. In the exemplary embodiments, the post-mix drink dispenser 11 delivers a diluent, such as particularly including either plain water or carbonated water, for mixing with one or more of eight concentrates. The post-mix drink dispenser 11 further delivers up to four flavor additives for mixing with the selected diluent and the one or more of eight concentrates.

While the exemplary embodiments of the post-mix drink dispenser 11 dispense eight concentrates and four flavor additives, one of ordinary skill in the art will recognize that no flavor additives are necessary and further only a single concentrate is required. Consequently, the post-mix drink dispenser 11 may include any number of concentrates and flavor additives based upon the dispensing requirements of the drink dispensing system 10. Moreover, multiple diluents of different types, such as plain water or carbonated water, may be supplied to the post-mix drink dispenser 11 for combining with the concentrates. Illustratively, carbonated water may be supplied to the post-mix drink dispenser 11 from a carbonated water source for combining with a concentrate or concentrates to produce a carbonated drink, or, alternatively, plain water may be supplied to the post-mix drink dispenser 11 from a plain water source for combining with a concentrate or concentrates to produce a non-carbonated drink. Although the drink dispensing system 10 shown in FIG. 1 illustrates a single post-mix drink dispenser 11, one of ordinary skill in the art will recognize that the drink dispensing system 10 may be expanded to incorporate two or more post-mix drink dispensers 11 whereby each multiple post-mix drink dispenser 11 receives either plain water or carbonated water. In addition, one of ordinary skill in the art will recognize that the drink dispensing system 10 and the post-mix drink dispenser 11 may be configured to receive both plain and carbonated water and dispense either a non-carbonated drink or a carbonated drink.

Referring to FIGS. 2-17, a first preferred embodiment of the post-mix drink dispenser 11 includes a mixer 30, a nozzle housing 69, and a vent formed unitary with the nozzle housing 69, as well as an aesthetic ring 25 as may be desired. For manufacturability, as well as to facilitate periodic, routine cleaning and/or any required maintenance of the post-mix drink dispenser 11, the mixer 30 is most preferably formed as a multi-body assembly comprising a stage one body 31, a stage two body 42, and a stage three body 57. Those of ordinary skill in the art, however, will recognize in light of this exemplary description that the benefits of the various described preferred embodiments of the post-mix drink dispenser 11 may be had with other structural arrangements of the mixer 30—including even a single-body arrangement—especially with the improvements in new manufacturing processes such as, for example, additive manufacturing.

In any case, the mixer 30 is, in the exemplary embodiments, dependently supported by a mounting plate 20, which in turn secures the post-mix drink dispenser 11 including the mixer 30 with the drink dispensing system 10 using any suitable means such as screws. To this end, the mounting plate 20 is shown to comprise a plurality of mounting holes 24 for use in attaching the mounting plate 20 to the drink dispensing system 10. Although the mounting plate 20 is implemented as separate component secured with the mixer 30, those of ordinary skill in the art will recognize that the mounting plate 20, or any substantially equivalent mounting member, may be formed integrally with the mixer 30. In the exemplary embodiments shown, however, the mounting plate includes a plurality of mixer mounting holes 22 through which conventional mounting hardware 36, such as, for example, screws, is utilized to affix the mixer 30 to the mounting plate 20.

Figure 5:
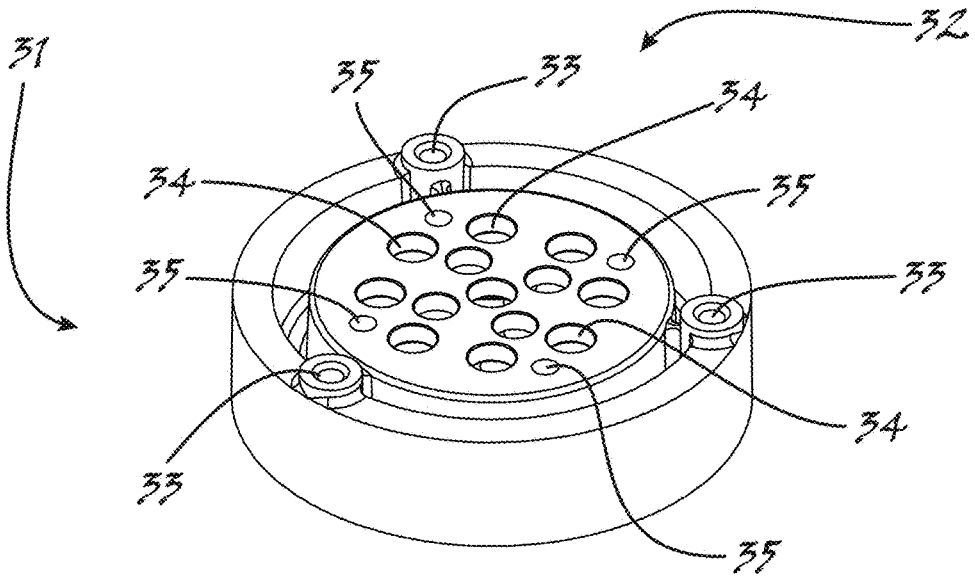
FIG. 5 is a top isometric view illustrating the stage one body of the mixer of the post-mix drink dispenser according to any of the described embodiments.
Figure 6:
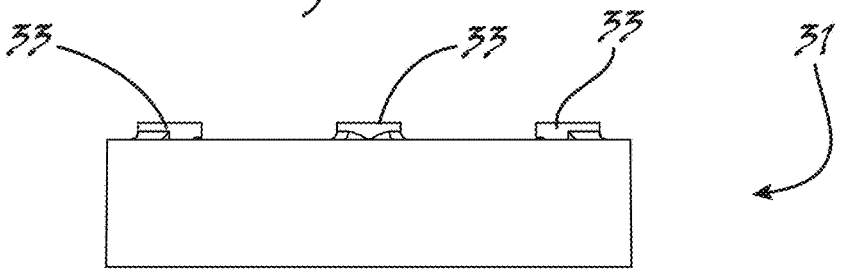
FIG. 6 is an elevational view illustrating the stage one body of the mixer of the post-mix drink dispenser according to any of the described embodiments.
Figure 7:
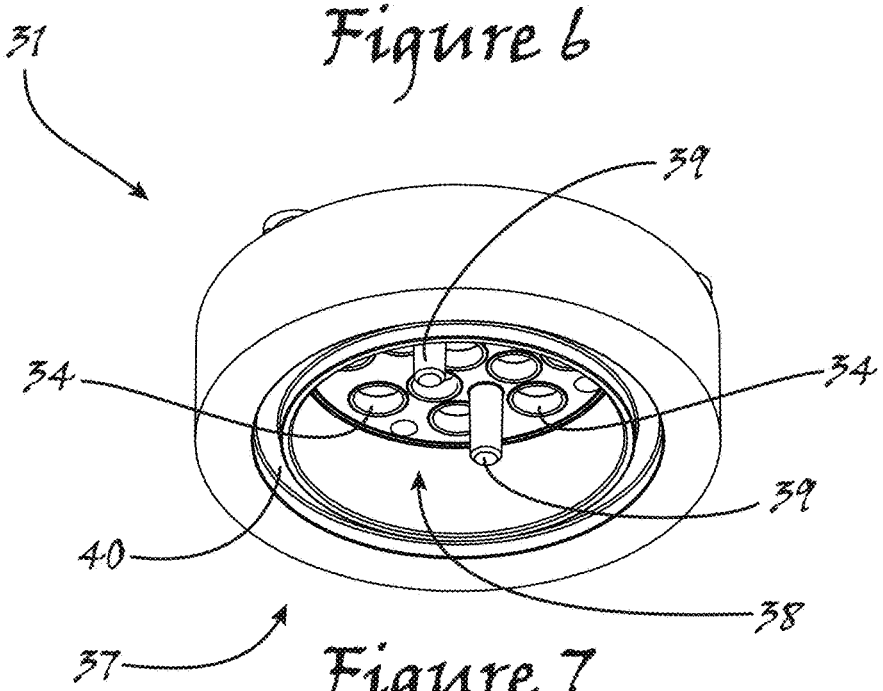
FIG. 7 is a bottom isometric view illustrating the stage one body of the mixer of the post-mix drink dispenser according to any of the described embodiments.

As particularly shown in FIGS. 5-7, the stage one body 31 of the mixer 30 generally takes a cylindrical shape having a top 32 and a bottom 37. The top includes a plurality of bosses presenting threaded mounting holes 33 corresponding to the mixer mounting holes 22 provided on the mounting plate 20, and adapted to receive the provided mixer mounting hardware 36. Although the stage one body 31 is generally cylindrical, the bottom 37 of the stage one body 31 largely comprises a cylindrical cavity 38, as best shown in FIG. 7. As is clear with reference to FIGS. 5 and 7, the top 32 of the stage one body 31 includes a plurality of connector orifices 34 and a plurality of stage two mounting holes 35, all of which are provided through the top 32 of the stage one body 31 so as to pass into the cylindrical cavity 38.

The stage one body 31 of the mixer 30 also includes a plurality of stand-offs 39, each of which projects, from the underside of the top 32 of the stage one body 31, downwardly into the cylindrical cavity 38. As particularly shown in FIGS. 2 and 14, a rubber seal 41 is received within the cylindrical cavity 38 of the stage one body 31 and sandwiched in place between the underside of the top 32 of the stage one body 31 and the top 43 of the stage two body 42. The downwardly projecting stand-offs 39 are each received within a stage one stand-off cavity 48 formed in the top 43 of the stage two body 42. When so engaged, the downwardly projecting stand-offs 39 operably cooperate with the stand-off cavities 48 to ensure proper spacing, with respect to the thickness of the rubber seal 41, between the underside of the top 32 of the stage one body 31 and the top 43 of the stage two body 42. Additionally, the stand-offs 39 operate to ensure correct rotational alignment of the rubber seal 41 as dependently supported between the stage one body 31 and the stage two body 42.

Figure 8:
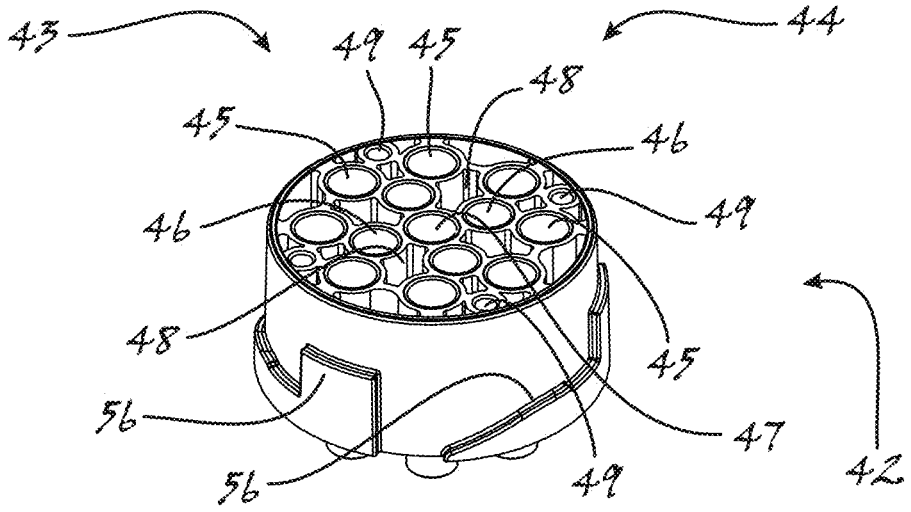
FIG. 8 is a top isometric view illustrating the stage two body of the mixer of the post-mix drink dispenser according to any of the described embodiments.
Figure 9:
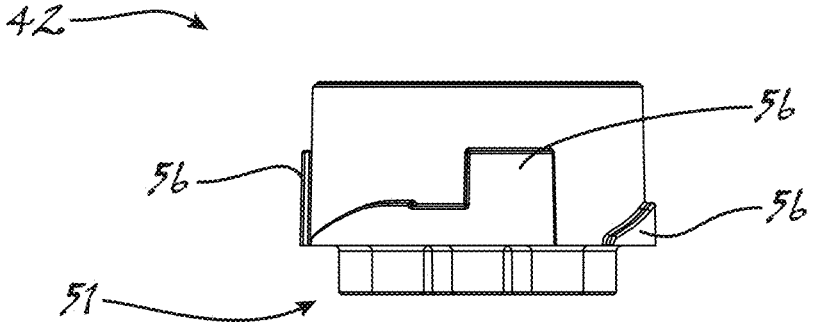
FIG. 9 is an elevational view illustrating the stage two body of the mixer of the post-mix drink dispenser according to any of the described embodiments.
Figure 10:
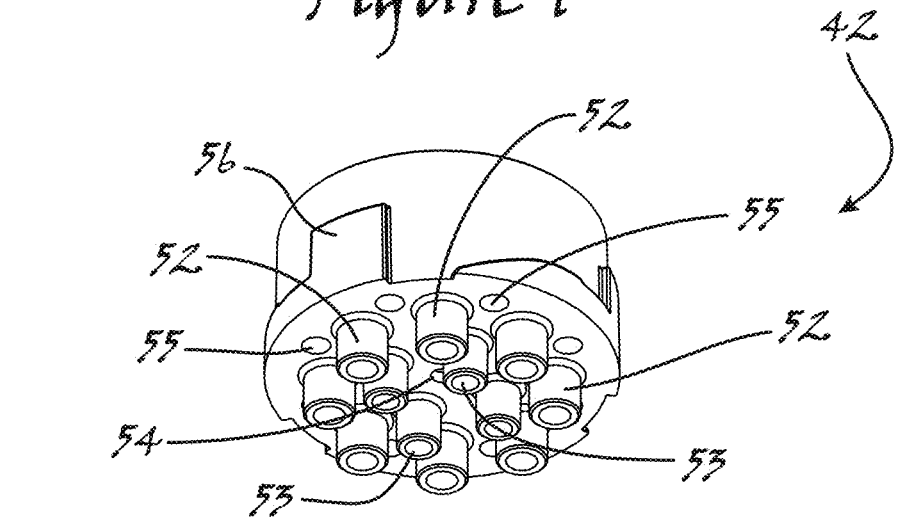
FIG. 10 is a bottom isometric view illustrating the stage two body of the mixer of the post-mix drink dispenser according to any of the described embodiments.

As particularly shown in FIGS. 8-10, the stage two body 42 of the mixer 30, like the stage one body 31, generally takes a cylindrical shape, and also has a top 43 and a bottom 50. As shown in the figures, the top 43 of the stage two body 42 comprises a plurality of connector tube receptacles 44, one connector tube receptacle 44 being provisioned for each concentrate and additive to be delivered through the post-mix drink dispenser 11, and one additional connector tube receptacle 44 being provisioned for delivery of diluents. Consequently, for the exemplary post-mix drink dispenser 11 as heretofore described, the stage two body 42 includes eight concentrate tube receptacles 45, which are circularly arranged about four additive tube receptacles 46, which are in turn circularly arranged about a single centrally located diluents tube receptacle 47. Additionally, the top 43 of the stage two body 42 includes a plurality of threaded mounting holes 49 corresponding to the stage two mounting holes 35 provided through the top 32 of the stage one body 31, and adapted to receive correspondingly provided conventional mounting hardware 23, such as, for example, screws.

Figure 2:
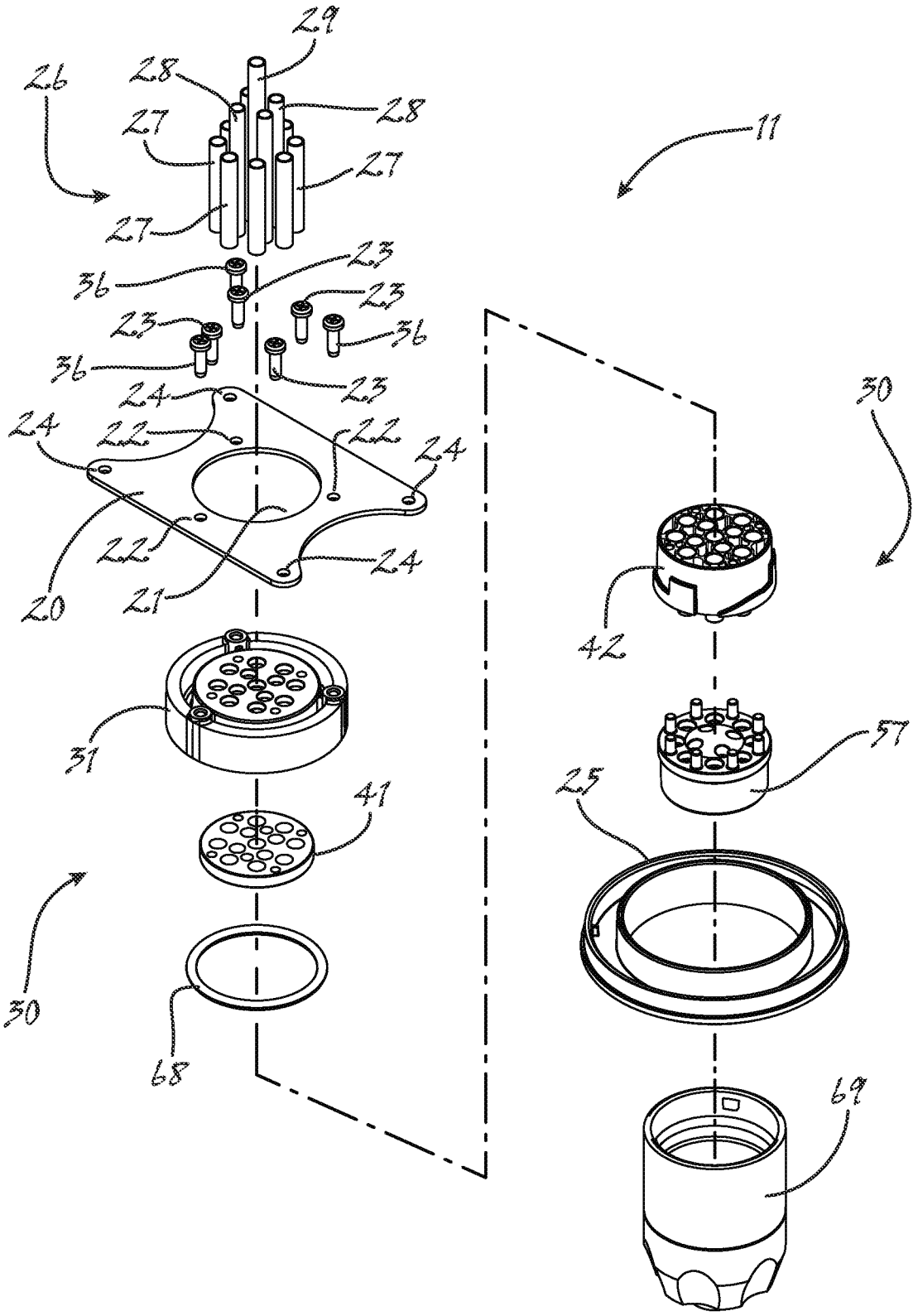
FIG. 2 is an exploded top isometric view illustrating the post-mix drink dispenser according to the first embodiment.
Figure 4:
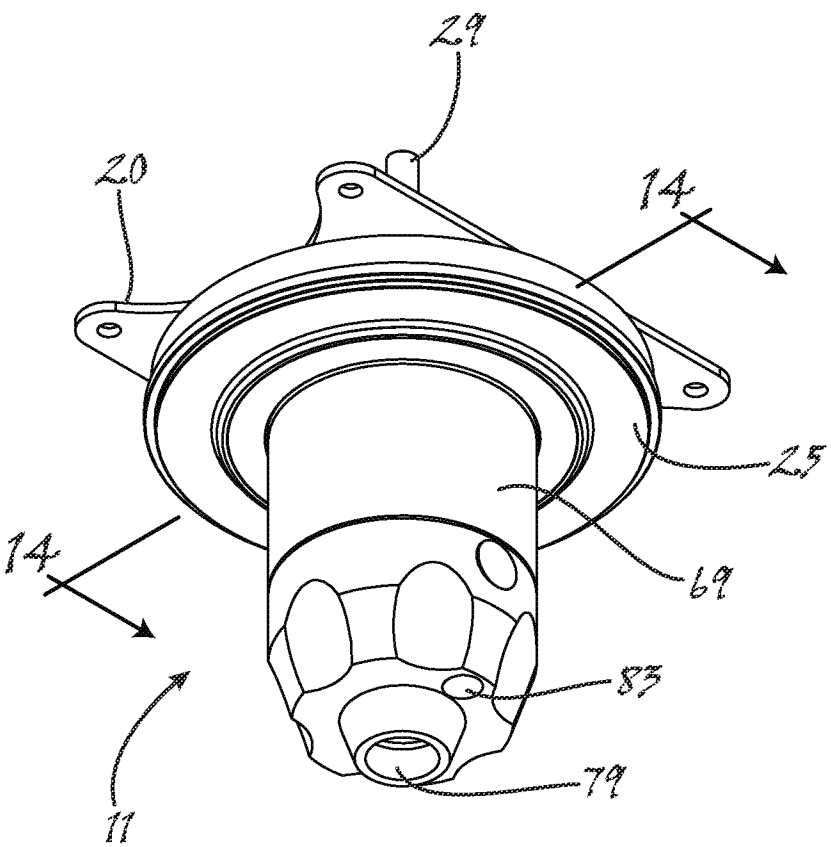
FIG. 4 is a bottom isometric view illustrating the post-mix drink dispenser according to the first embodiment.
Figure 14:
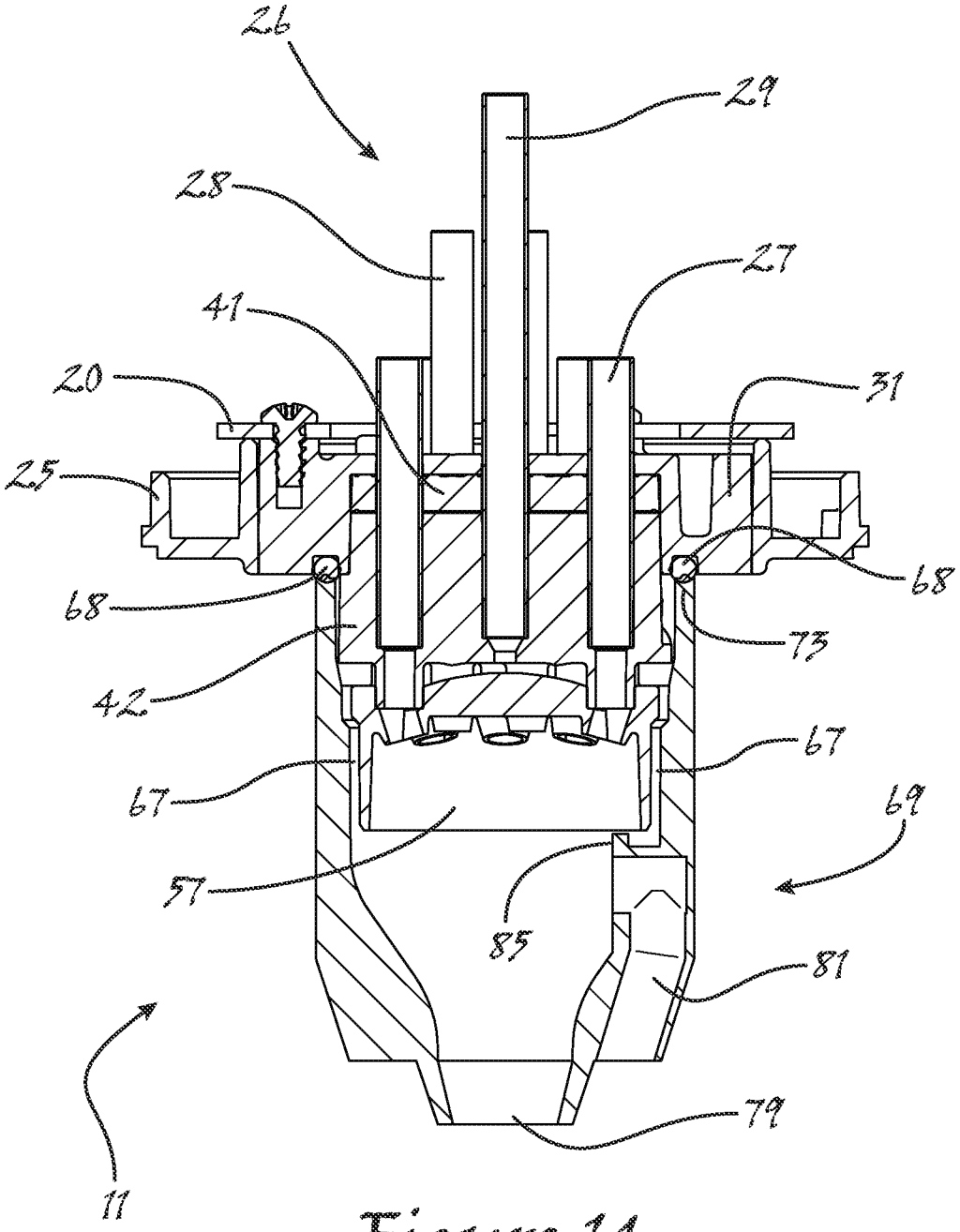
FIG. 14 is cross-sectional elevational view taken along lines 14-14 of FIG. 4 illustrating the post-mix drink dispenser according to the first embodiment.
Figure 15:
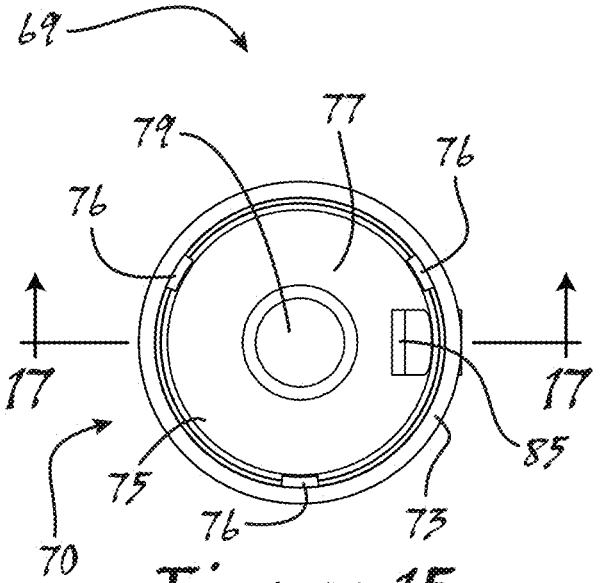
FIG. 15 is a top plan view illustrating the nozzle housing with integral vent of the post-mix drink dispenser according to the first embodiment.
Figure 17:
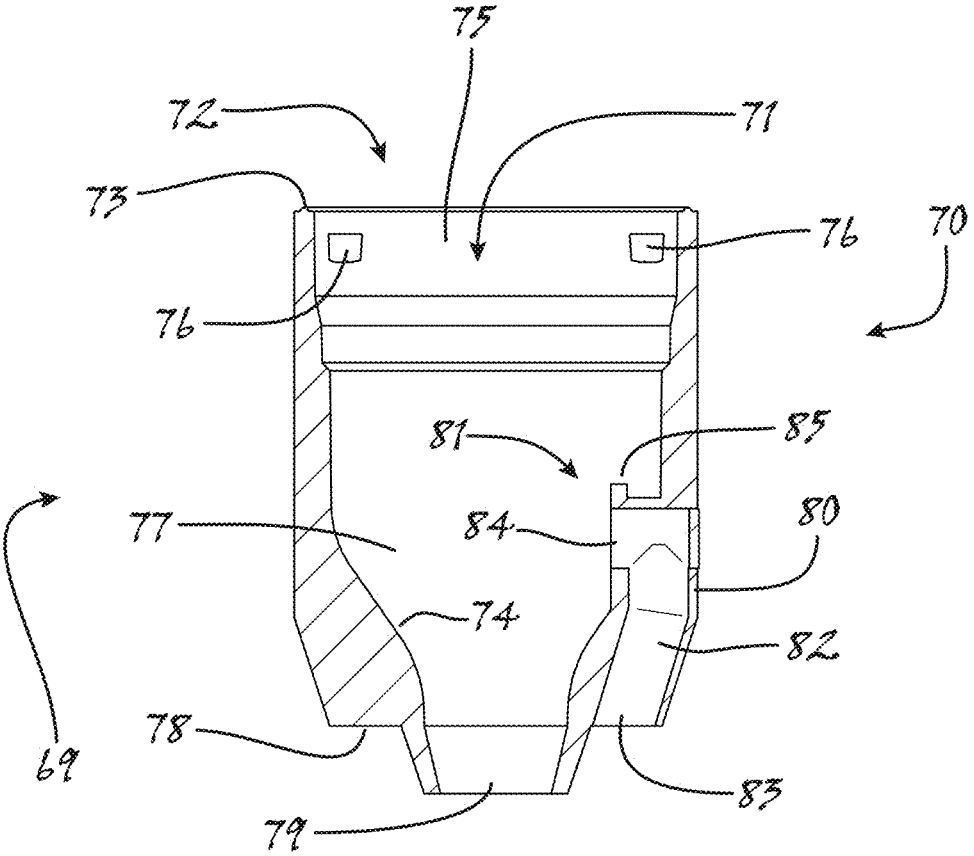
FIG. 17 is a cross-sectional elevational view taken along lines 17-17 of FIG. 15 illustrating the nozzle housing with integral vent of the post-mix drink dispenser according to the first embodiment.

As also shown in FIGS. 8-10, the stage two body 42 includes a plurality of nozzle housing locking members 56 for dependently securing the nozzle housing 69 in place as an integral component of the post-mix drink dispenser 11. To this end, and as shown in FIGS. 15 and 17, the nozzle housing 69 comprises a corresponding plurality of locking tabs 76, which are located about the upper portion 75 of the inner surface 74 of the nozzle housing 69. In order to provide a fluid tight seal at the top edge 73 about the inlet 72 of the nozzle housing 69, which generally comprises a walled body 70 having a substantially open interior 71, an O-ring 68 is provided and received within an O-ring recess 40 located about the cylindrical cavity 38 at the bottom 37 of the stage one body 31, as shown in FIGS. 2, 7 and 14. Additionally, it is noted, the O-ring also provides some compressibility under force, thereby enabling the interoperation of the locking tabs 76 and the nozzle housing locking members 56 during placement or removal of the nozzle housing 69.

Figure 3:
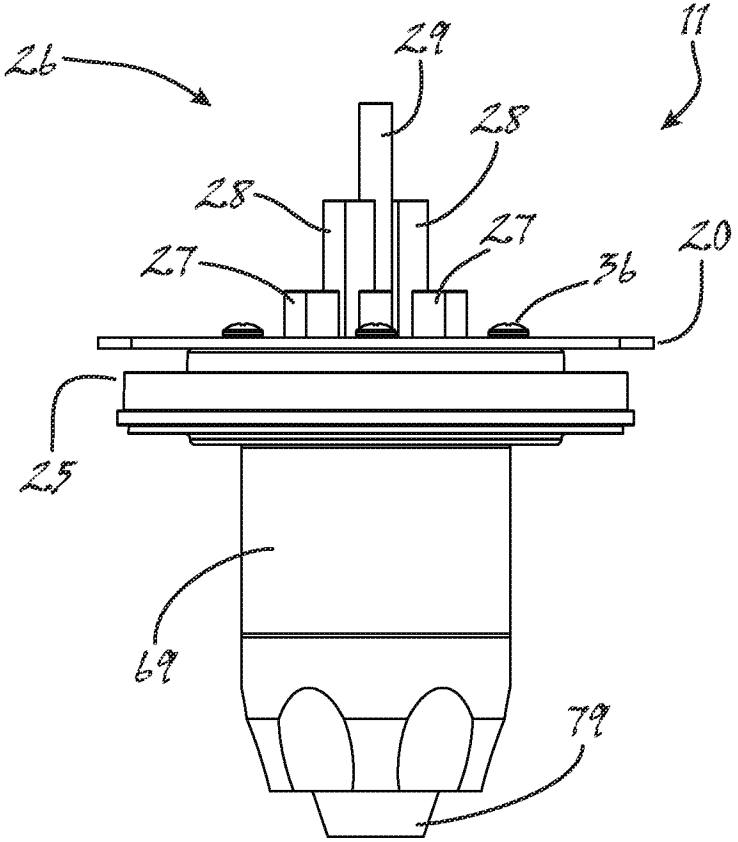
FIG. 3 is a left side elevational view illustrating the post-mix drink dispenser according to the first embodiment.

Referring now to FIGS. 2, 3 and 14, the first preferred embodiment of the post-mix drink dispenser 10 is shown to also comprise a plurality of connector tubes 26 for conveying liquid beverage components into the post-mix drink dispenser 11. In particular, the exemplary post-mix drink dispenser 11 as heretofore described is shown to include eight connector tubes 26 providing concentrate pathways 27, which are circularly arranged about four connector tubes 26 providing additive pathways 28, which are in turn circularly arranged about a single centrally located connector tube 26 providing a diluents pathway 29. In the assembled post-mix drink dispenser 10, as shown in FIG. 14, a first end of each provided connector tube 26 passes through a central orifice 21 of the mounting plate 20, and a corresponding connector orifice 34 through the stage one body 31, and is matingly received within a corresponding connector tube receptacle 44 in the top 43 of the stage two body 42. As shown in FIG. 14, the rubber seal 41 is sized and shaped to ensure a fluid tight engagement of each connector tube 26 as seated within its respective connector tube receptacle 44.

The bottom 50 of the stage two body 42 includes a plurality of downwardly projecting fluid conduits 51, as best shown in FIGS. 9-10, for channeling concentrates and additives from the concentrate tube receptacles 45 and the additive tube receptacles 46, respectively, and into the interior of the stage three body 57. In the assembled post-mix drink dispenser 10, as shown in FIG. 14, and best understood with reference to FIGS. 11-13, each provided downwardly projecting fluid conduit 51 is sized, shaped and located to sealingly insert a distance into a nozzle inlet 60 provided at the top 58 of the stage three body 57. Specifically, each concentrate conduit 52 mates with a concentrate inlet 60 to provide fluid communication between a concentrate pathway 27 and a corresponding one of the directional nozzles 66. Likewise, each additive conduit 53 mates with an additive inlet 61 to provide fluid communication between an additive pathway 28 and a corresponding one of the directional nozzles 66.

Figure 12:
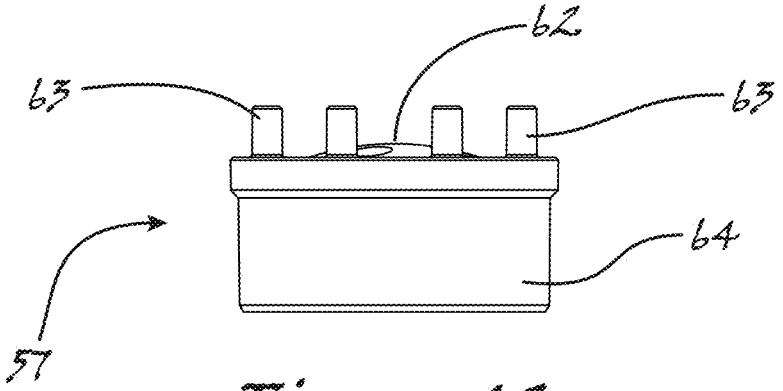
FIG. 12 is an elevational view illustrating the stage three body of the mixer of the post-mix drink dispenser according to any of the described embodiments.
Figure 13:
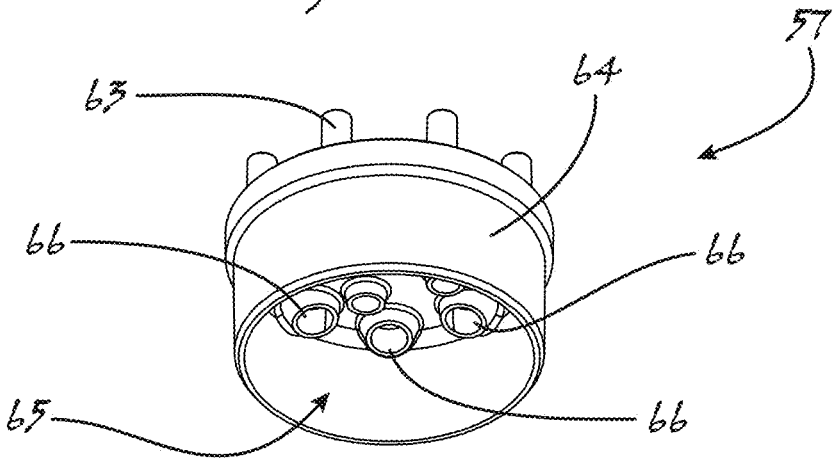
FIG. 13 is a bottom isometric view illustrating the stage three body of the mixer of the post-mix drink dispenser according to any of the described embodiments.

Importantly, it is noted, diluents passing through the stage two body 42 are not channeled into the interior of the stage three body 57 as are concentrates and additives. Unlike concentrates and additives, diluents pass from the diluents tube receptacle 47 and out an open orifice 54 centrally provided in the bottom 50 of the stage two body 42, and then are directed into a specially formed annular diluents passage 67. As best shown in FIG. 13, the directional nozzles 66 of the stage three body 57 project downwardly from the underside of the top 58 of the stage three body 57, and are sheltered within a cylindrical cavity 65 formed at the bottom of the stage three body 57 by a downwardly projecting sidewall 64. As particularly shown in FIG. 14, and with reference to FIGS. 11-13, the annular diluents passage 67 is formed in a space created between the bottom part of the upper portion 75 of the inner surface 74 of the nozzle housing and the exterior of the downwardly projecting sidewall 64.

Figure 11:
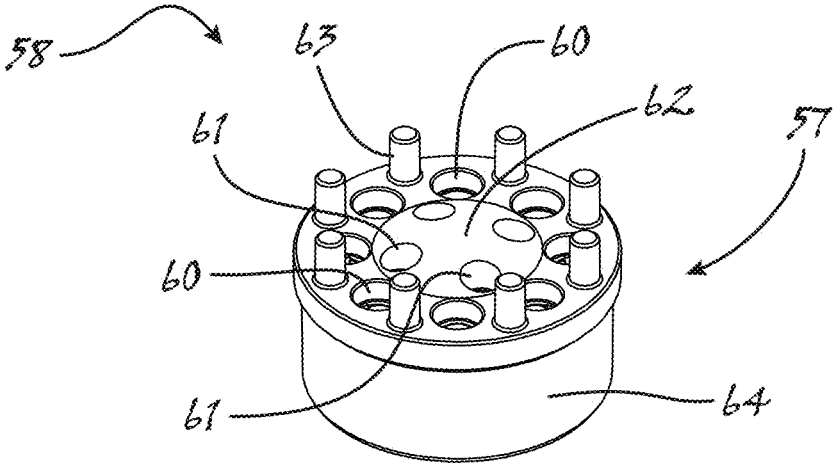
FIG. 11 is a top isometric view illustrating the stage three body of the mixer of the post-mix drink dispenser according to any of the described embodiments.

In order to ensure the free flow of diluents passing from the open orifice 54 in the bottom 50 of the stage two body 42 and into the annular diluents passage 67 about the outer circumference of the stage three body 57, a space is maintained between the top 58 of the stage three body 57 and the bottom 50 of the stage two body 42, as best shown in FIG. 14. As shown in FIGS. 11-13, the stage three body 57 includes a plurality of upwardly projecting stand-offs 63, which are each received within a corresponding stage three stand-off cavity 55 provided about the bottom 50 of the stage two body 42, as shown in FIG. 10. The stand-offs 63 and cavities 55 are sized and otherwise cooperatively adapted to produce the desired spacing as well as alignment between the top 58 of the stage three body 57 and the bottom 50 of the stage two body 42. To promote flow of diluents off the top 58 of the stage three body 57, and outwardly all around into the annular diluents passage 67, the top 58 of the stage three body 57 also most preferably comprises a convex central region 62, as shown in FIGS. 11, 12 and 14.

In any case, it should be understood that concentrates and additives flow through the mixer 30 and out of the directional nozzles 66 within the interior space of the cylindrical cavity 65 of the stage three body 57. As the concentrates and additives are discharged from the mixer 30, the directional nozzles 66 generally orient the flows inwardly toward the central vertical axis running through an outlet 79 in the bottom 78 of the nozzle housing 69. Diluents, on the other hand, flow around the stage three body 57, through the annular diluents passage 67, and are discharged from the mixer 30 adjacent the inner surface 74 of the nozzle housing 69. The concentrates and additives thus first combine in the tapered lower portion 77 of the nozzle housing 69, and the concentrates and additives are kept away from surfaces of the mixer 30, as well as surfaces of the nozzle housing 69 above the bottom of the stage three body 57. While the stage one body 31 and the stage two body 42 receive the diluents pathway 29 for the delivery of a diluent, one of ordinary skill in the art will recognize that the stage one body 31 and the stage two body 42 may be configured to incorporate a second diluents pathway for the delivery of a second diluent.

Although the foregoing discussion is presented with reference to the first preferred embodiment of the post-mix drink dispenser 11, and in particular with reference to a nozzle housing 69 shown to comprise a vent 81 formed unitary with the nozzle housing 69, it should at this juncture be clearly noted that, with the exception of the unitary vent 81, the foregoing detailed description defines a structure that is universal to each preferred embodiment of the post-mix drink dispenser 11 described herein. Although the descriptions to follow of those details particular to one or more of the preferred embodiments of the post-mix drink dispenser 11 include reference to differing nozzle housings 69, 87, 108, each adapted to accommodate particular features of a respective embodiment, those features of the nozzle housing 69 of the first preferred embodiment heretofore discussed, including in particular the manner of attachment to the mixer 30 and formation of the annular diluents passage 67, apply to each preferred embodiment. Likewise, the post-mix drink dispenser 11 absent any nozzle housing 69, 87, 108 may be considered a universal host for attachment of any of the nozzle housings 69, 87, 108.

Returning particularly to the first preferred embodiment of the post-mix drink dispenser 11 of the present invention, as shown in FIGS. 14-17, the nozzle housing 69 includes a unitary air replacement vent 81 formed in a lower wall portion 80 of the nozzle housing 69. As best shown in FIG. 17, the vent 81 comprises a channel 82 running from an air inlet 83, at the exterior of the nozzle housing 79, to an air outlet 84, at the interior 71 of the nozzle housing 69. As will be appreciated by those of ordinary skill in the art, in light of this exemplary description, the channel 82 may, if necessary or desired to facilitate manufacture of the unitary vent 81, be initially molded through the walled body 70 of the nozzle housing 69, and thereafter completed by placement of a plug 86, which plug 86 may, for example, be readily fixed by sonic welding or the like.

Figure 16:
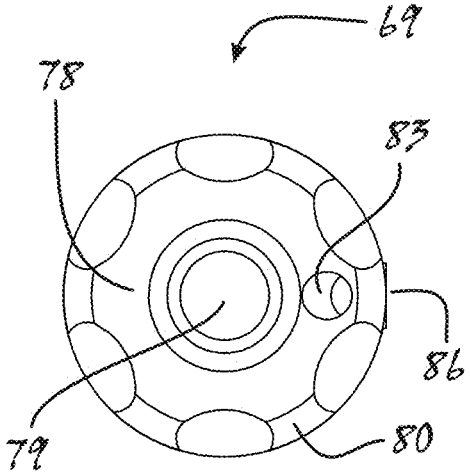
FIG. 16 is a bottom plan view illustrating the nozzle housing with integral vent of the post-mix drink dispenser according to the first embodiment.

As will be better understood further herein, the inlet 83 of the vent 81 is most preferably disposed at the bottom 78 of the nozzle housing 69, and angled toward the central vertical axis running through the outlet 79 in the bottom 78 of the nozzle housing 69, as particularly shown in FIGS. 16-17. The outlet 84 of the vent 81 projects from within the lower wall portion 80 of the nozzle housing 69, and transversely into the interior 71 of the nozzle housing 69. As best shown in FIG. 14, the outlet 84 terminates a sufficient distance into the interior 71 of the nozzle housing 69 as to be located below, and within the circumferential extents of the cylindrical cavity 65 of, the stage three body 57 of the mixer 30. Finally, a wall 85 is formed about the outlet 84 of the vent 81, and serves to divert diluents flowing from annular passage 67 about the vent 81, thereby preventing ingress of fluids to the vent 81.

Incorporation of the post-mix drink dispenser 11 into the drink dispensing system 10 as illustrated in FIG. 1 begins with the assembly of the post-mix drink dispenser 11. As previously described, and particularly shown in FIGS. 2 and 14, the mixer 30 is assembled and fitted with the connector tubes 26, and dependently affixed to the mounting plate 20. In the first preferred embodiment of the post-mix drink dispenser 11, the locking tabs 76 of the nozzle housing 69 reside adjacent the nozzle housing locking members 56 about the stage two body 42, whereby rotation of the nozzle housing 69 couples the nozzle housing 69 with the mixer 30, forming a seal between the top edge 73 about the inlet 72 of the nozzle housing 69 and the bottom 37 of the stage one body 31. After assembly of the post-mix drink dispenser 11, the mounting plate 20 secures the post-mix drink dispenser 11 with the drink dispensing system 10 using the mounting holes 24 and any suitable means such as screws.

In each embodiment of the present invention, the drink dispensing system 10 includes a housing 12, which may be a tower securable to a suitable support platform such as a countertop or product cooling container. The housing 12 includes product lines 17 that deliver diluents, concentrate, and flavor additives to the post-mix drink dispenser 11. One of the product lines 17 is a diluent line that connects with a diluent source, such as particularly include a pressurized carbonated water system or a pressurized plain water system, either directly or through a cooling system such as a cold plate when cooled diluent is desired. Eight product lines 17 in the described exemplary embodiments are concentrate lines that each connect with a concentrate source, such as a bag in a box (BIB), either directly or through a cooling system such as a cold plate when cooled concentrate is desired. Four product lines 17 in the described exemplary embodiments are additive lines that each connect with an additive source, such as a bag in a box (BIB), either directly or through a cooling system such as a cold plate when cooled additive is desired.

Additionally, the housing 12 includes a drip tray 13, located at the base of a drink dispensing nook formed in the space beneath the post-mix drink dispenser 11, and in fluid communication with a drain 14. In ordinary use of the present invention, a user places a beverage cup 15 in the dispensing nook, as shown in FIG. 1, and a drink is dispensed from the post-mix drink dispenser 11 into the open top 16 of the beverage cup 15. In the absence of a beverage cup 15, or in the case of "bad pours" as may arise in the absence of the benefits of the present invention, the drip tray 13 is intended to capture flows from the post-mix drink dispenser 11, and dispose of them through the drain 14. Although such "bad pours" are largely eliminated by the various preferred embodiments of the present invention, the drip tray 13 and drain 14 are, of course, nonetheless desired in order to accommodate a situation where the user initiates a pour without a beverage cup 15 properly in place or simply over pours the beverage.

The drink dispensing system 10 in the described exemplary embodiments includes back blocks, as generally known in the art. A back block connects at an inlet with the diluent line of the product lines 17 and at an outlet with a flow rate controller, which may be any suitable flow rate controller such as a solenoid operated flow rate control valve including a spring-loaded ceramic piston well known to one of ordinary skill in the art. The flow rate controller connects with the diluents pathway 29 of the post-mix drink dispenser 11 using any suitable means such as flexible tubing to deliver diluent to the post-mix drink dispenser 11 at a desired flow rate. Similarly, a back block each connects at an inlet with one of the concentrate lines of the product lines 17 and at an outlet with a flow rate controller, which may be any suitable flow rate controller such as a solenoid operated flow rate control valve including a spring-loaded ceramic piston well known to one of ordinary skill in the art. Each flow rate controller connects with one of the concentrate pathways 27 of the post-mix drink dispenser 11 using any suitable means such as flexible tubing to deliver concentrate to the post-mix drink dispenser 11 at a desired flow rate. Likewise, a back block each connects at an inlet with one of the additive lines of the product lines 17 and at an outlet with a flow rate controller, which may be any suitable flow rate controller such as a solenoid operated flow rate control valve including a spring-loaded ceramic piston well known to one of ordinary skill in the art. Each flow rate controller connects with one of the additive pathways 28 of the post-mix drink dispenser 11 using any suitable means such as flexible tubing to deliver concentrate to the post-mix drink dispenser 11 at a desired flow rate.

In each embodiment of the present invention, the post-mix drink dispenser 11 receives via the concentrate lines and the additive lines concentrates and additives pumped from BIB's. Illustratively, a pump, as generally known in the art, connects at an inlet with an exit port of a BIB and at an outlet with one of the concentrate lines or additive lines of the product lines 17 for the drink dispensing system 10 to deliver concentrate/additive thereto. The pump may be any pump suitable to pump concentrates/additives, such as a gas operated piston pump well known to one of ordinary skill in the art.

The drink dispensing system 10 in each embodiment of the present invention also includes a control system 18 having a user input 19, which is a touch screen in the described exemplary embodiments, to receive user drink choice selections and allow a technician to configure the drink dispensing system 10. The control system 18 electrically connects and communicates with the pumps and the flow rate controllers to control the delivery of a drink from the post-mix drink dispenser 11. The control system 18 may be any microcontroller, CPU, microprocessor, or the like suitable to control the drink dispensing system 10. The user input 19 presents drink choices including additive choices to a user. A user touches the user input 19 at choice icons to select a concentrate and any additives. The control system 18 receives the user choices and activates the flow rate controller for the diluent, the flow rate controller and the pump corresponding with the selected concentrate, and any flow rate controllers and pumps associated with selected additives such that diluent and concentrate and any additives are delivered from the post-mix drink dispenser 11. The control system 18 maintains the diluent, concentrate, and additive flow rate controllers and the pumps activated until the end of a dispense, which may be either timed or upon the user breaking contact with the user input 19.

The operation of the post-mix drink dispenser 11 in delivering a drink will be described herein with reference to an exemplary one of the concentrate pathways 27, an exemplary one of the additive pathways 28, and the mixer 30 to provide an example thereof. Although only a single one of the concentrate pathways 27 and a single one of the additive pathways 28 are described, it should be understood by one of ordinary skill in the art that each of the concentrate pathways 27 and each of the additive pathways 28 are identical in design, configuration, and function, and, as earlier noted, more than one additive pathway 27 and/or more than one additive pathway 28 may be utilized in any one dispense.

A concentrate containing BIB connects with a pump, and the pump connects with a concentrate line of the product lines 17 communicating with an exemplary one of the concentrate pathways 27. Similarly, an additive containing BIB connects with a pump, and the pump connects with an additive line of the product lines 17 communicating with an exemplary one of the additive pathways 28.

Before dispensing a drink, a technician must configure the drink dispensing system 10 by setting the flow rates of the diluent, concentrates, and additives to the desired flow rates that achieve the volumetric flow rate ratios necessary for proper tasting drinks. Illustratively, the technician measures at least the flow rate of the diluent, and, if necessary, the flow rates of the concentrate coupled with the exemplary one of the concentrate pathways 27 and the additive coupled with the exemplary one of the additive pathways 28. The technician then determines the adjustments necessary to produce the correct volumetric flow rate ratios. The technician adjusts the diluent, concentrate, and additive flow rate controllers until the actual flow rates of the diluent, concentrate, and additive exiting the post-mix drink dispenser 11 corresponds with the desired diluent, concentrate, and additive flow rates.

Responsive to the display of drink and additive choices by the user input 19, a user touches the user input 19 at a drink choice, which, in the present example, corresponds with the concentrate coupled with the exemplary one of the concentrate pathways 27. The control system 18 registers the drink choice and in response thereto activates the diluent flow rate controller and the concentrate flow rate controller and pump coupled with the exemplary one of the concentrate pathways 27. The diluent flows through the diluents pathway 29 and into and through the mixer 30, the diluent exiting the mixer 30 by way of the annular diluents passage 67, as previously described. Similarly, the concentrate flows through the exemplary one of the concentrate pathways 27 and into and through the mixer 30, the concentrate exiting the mixer 30 by way of the one of the directional nozzles 66 in fluid communication with the exemplary one of the concentrate pathways 27.

As previously described, the diluent flows around the stage three body 57 and through the annular diluents passage 67 and is discharged from the mixer 30 adjacent the inner surface 74, and at the tapered lower portion 77, of the nozzle housing 69. The concentrate coupled with the exemplary one of the concentrate pathways 27 flows through the mixer 30 and out of the one of the directional nozzles 66 in fluid communication with the exemplary one of the concentrate pathways 27, and is thereby discharged from the mixer 30 toward the tapered lower portion 77 of the nozzle housing 69, where the concentrate and diluent mixes together. The mixed diluent and concentrate then flows through and from the outlet 79 of the nozzle housing 69, and into the open top 16 of a beverage cup 15, or like container, placed below the nozzle housing 69, thereby forming a drink for the user.

A drink choice may also include the incorporation of an additive whereby a user touches the user input 19 at an additive choice, which, in the present example, corresponds with the additive coupled with the exemplary one of the additive pathways 28. The control system 18 registers the additive choice and in response thereto activates the additive flow rate controller and the pump coupled with the exemplary one of the additive pathways 28. The additive flows through the exemplary one of the additive pathways 28 and into and through the mixer 30, the concentrate exiting the mixer 30 by way of the one of the directional nozzles 66 in fluid communication with the exemplary one of the additive pathways 28.

The additive coupled with the exemplary one of the additive pathways 28 flows through the mixer 30 and out of the one of the directional nozzles 66 in fluid communication with the exemplary one of the additive pathways 28, and is thereby discharged from the mixer 30 toward the tapered lower portion 77 of the nozzle housing 69, where the additive contacts mixed diluent and concentrate. The mixed diluent, concentrate, and additive then flows through and from the outlet 79 of the nozzle housing 69, and into the open top 16 of a beverage cup 15, or like container, placed below the nozzle housing 69, thereby forming a drink for the user.

The control system 18 maintains the diluent flow rate controller, the concentrate flow rate controller and the pump coupled with the exemplary one of the concentrate pathways 27, and if selected the additive flow rate controller and the pump coupled with the exemplary one of the additive pathways 28 activated during the user-initiated drink dispense. The user initiated drink dispense begins with the user touching the user input 19 to make a drink choice and if desired an additive choice and ends when the user breaks contact with the user input 19 or after the expiration of a drink dispense time period. The diluent flow rate controller and the concentrate flow rate controller and the pump coupled with the exemplary one of the concentrate pathways 27 remain activated during the user-initiated drink dispense, whereas the additive flow rate controller and the pump coupled with the exemplary one of the additive pathways 28 remains activated only for a period of time necessary to deliver an additive shot into the dispensed drink. Upon the user breaking contact with the user input 19 or the expiration of the drink dispense time period, the control system 18 deactivates the diluent flow rate controller, the concentrate flow rate controller and the pump coupled with the exemplary one of the concentrate pathways 27, and if activated the additive flow rate controller and the pump coupled with the exemplary one of the additive pathways 28. The control system 18 may continue the flow of diluent briefly after the control system 18 ceases the flow of concentrate and additive to ensure that all concentrate and/or additive is removed from the inner surface 74 of the nozzle housing 69.

Although the foregoing discussion of the preferred method of operation of the present invention is presented with reference to the nozzle housing 69 of the first preferred embodiment of the post-mix drink dispenser 11, it should at this juncture be clearly noted that the foregoing detailed description defines a mode of operation that is universal to each preferred embodiment of the post-mix drink dispenser 11 described herein. Although the descriptions to follow of those details particular to one or more of the preferred embodiments of the post-mix drink dispenser 11 include reference to differing nozzle housings 69, 87, 108, as well as details of how those structures vary the operation of the present invention, those aspects of the operation of the post-mix drink dispenser 11 heretofore discussed, including in particular the introduction to and passage from the mixer 30 of diluents and one or more concentrates and/or additives, apply to each preferred embodiment. Likewise, the operation of the post-mix drink dispenser 11 absent any nozzle housing 69, 87, 108 may be considered universally applicable to the more particular operation of the post-mix drink dispenser 11 including one of the described nozzle housings 69, 87, 108.

Returning then particularly to the use of the first preferred embodiment of the post-mix drink dispenser 11 of the present invention, the operation of the air replacement vent 81 formed unitary with the nozzle housing 69 of the first preferred embodiment of the post-mix drink dispenser 11, as shown in FIGS. 14-17, is now described in detail. As a prelude to this detailed description, however, and as discussed in the Background of the Invention, it is noted that in operation of such a nozzle absent an air replacement vent 81 color carry-over issues may arise. In particular, as a diluent, alone or mixed with concentrate and/or additive, flows through and from the outlet 79 of the nozzle housing 69 a fluid seal may be formed at the outlet 79. If so, an air bubble is created and trapped within and beneath the cylindrical cavity 65 of the stage three body 57 of the mixer 30. As the diluent, and especially plain water, flows from the annular diluents passage 68 and about the otherwise trapped air bubble, the diluent flow will pull in and take a portion of the air through the outlet 79 of the nozzle housing 69. As the air bubble reduces in size, a negative pressure is created, which causes a portion of the liquid beverage flow to be pulled in to the space within and beneath the cylindrical cavity 65 of the stage three body 57, thereby at least substantially, and generally completely, backfilling the space within and beneath the cylindrical cavity 65 of the stage three body 57 with the otherwise dispensed liquid beverage.

Although, on completion of the dispense, the drawn up liquid beverage will fall with gravity through the outlet 79 of the nozzle housing 69, whereby the majority of the liquid will be collected in the beverage cup 15, remnants will remain. In the most typical cases, where the diluent is mixed with one or more concentrates and/or additives, the dispensed liquid beverage backfilling the space within and beneath the cylindrical cavity 65 of the stage three body 57 will often carry a colored element. Additionally, as the liquid beverage backfills toward the top of the cylindrical cavity 65 of the stage three body 57, the liquid beverage will envelope and invade each of the directional nozzles 66, making it virtually certain that a colored element will be introduced into the dispensed liquid beverage. Either scenario, however, poses potential quality issues.

In cases where a colored element of a beverage is present in the backfilling liquid as a component of the beverage being dispensed, the dispensed beverage containing the colored component will be brought into contact with the surfaces within the cylindrical cavity 65 of the stage three body 57, including the interior face of the downwardly projecting circumferential sidewall 64 and the exterior, and to some extent interior, surfaces of the directional nozzles 66. Of note, surfaces within the cylindrical cavity 65 of the stage three body 57 of the mixer 30 are not subject washing down with a flow of diluent after the control system 18 ceases the flow of concentrate and additive. As a result, the often syrupy colored components of the beverage will tend to cling to these surfaces, and, rather than dropping out on completion of the dispense with the majority of the backfilled liquid, the clinging liquid will remain in place for at least some time following the dispense. This temporary retention, in turn, presents at least three quality issues. First, the retained colored liquid may drip into a subsequently mixed beverage of a lighter or no color, thereby presenting an off-colored beverage to the user. Second, a retained liquid (of any color) mixing with a dissimilar liquid may result in cross-contamination detectable by the user as an off-flavored beverage. Third, and perhaps of the most consequence, the retained colored liquid may drip through the outlet 79 of the nozzle housing 69 between dispenses, and while a user is placing a beverage cup 15 or otherwise inserting a hand or forearm within the dispensing nook formed in the space beneath the post-mix drink dispenser 11. In this case, the user will have the unpleasant experience of a likely syrupy liquid contacting the skin, or perhaps worse, staining the user's clothing.

In cases where a colored concentrate or additive is introduced into the backfilling liquid as the backfilling liquid envelopes and/or invades the directional nozzles 66 at the top of the cylindrical cavity 65 of the stage three body 57, the same three quality issues discussed above will be present. Additionally, however, if the backfilling liquid is being drawn in from a dispensing beverage that is of a light color or is clear, the dispense in progress may become off-colored. Still further, however, it is noted that a substantial quantity of undesired concentrate and/or additive may be introduced over a substantial fraction of the mixing duration. As a result, this modality may also result in an off-flavored beverage.

As previously described, the first preferred embodiment of the post-mix drink dispenser 11 of the present invention includes an air replacement vent 81 formed unitary with the nozzle housing 69. As shown in FIGS. 14-17, the air replacement vent 81 provides a channel 82 running from an air inlet 83 at the bottom 78 of the nozzle housing 69 to an air outlet 84 terminating in the portion of the interior space 71 of the nozzle 69 that is beneath the cylindrical cavity 65 of the stage three body 57 of the mixer 30. As a diluent, alone or mixed with concentrate and/or additive, flows through and from the outlet 79 of the nozzle housing 69 a fluid seal may be formed at the outlet 79. In the exemplary first preferred embodiment of the post-mix drink dispenser 11, however, the terminal end of the air outlet 84 from the vent 81 is located within the extents of the air bubble within and beneath the cylindrical cavity 65 of the stage three body 57 of the mixer 30. As a result, as the diluent flows from the annular diluents passage 68 and about the otherwise trapped air bubble, any portion of the air pulled into the diluent flow and taken with the flow through the outlet 79 of the nozzle housing 69 is simultaneously replaced by air freely flowing into the inlet 83, through the channel 82 and out of the outlet 84. Because no negative pressure is created, the liquid beverage flows uniformly and unimpeded through the outlet 79 from the nozzle housing 69, and no backfilling takes place. As will be appreciated by those of ordinary skill in the art in light of this exemplary description, the diameter of the outlet 79 will meter the rate of flow of a beverage, and should be selected accordingly. It is also noted, however, that the depicted extended length of the outlet 79 is found by Applicant to help develop or otherwise facilitate uniform flow from the outlet.

As previously described, the outlet 84 terminates a sufficient distance into the interior 71 of the nozzle housing 69 as to be located below, and within the circumferential extents of the cylindrical cavity 65 of, the stage three body 57 of the mixer 30, but also most preferably includes a wall 85 formed about the outlet 84 of the vent 81. As also previously noted, this provision serves to divert diluents flowing from the annular passage 67 about the vent 81, thereby preventing ingress of fluids to the vent 81. In this manner, user satisfaction in use of the present invention is facilitated by preventing dripping of beverage fluids from the air inlet 83 and onto the user or the user's clothing. The inlet 83 of the vent 81 is most preferably disposed at the bottom 78 of the nozzle housing 69, and angled toward the central vertical axis running through the outlet 79 in the bottom 78 of the nozzle housing 69, as particularly shown in FIGS. 16-17. Although other arrangements are possible within the scope of the present invention, the depicted and described most preferred arrangement further facilitates user satisfaction in use of the present invention. In particular, it is noted that if the outlet 79 from the nozzle housing 69 should become partially or fully occluded during a dispense, such as may happen if a user intentionally or inadvertently places a finger or other object into or over the outlet 79, the dispensing beverage will flow into the air outlet 84, backwards through the vent 81, and out of the air inlet 83, notwithstanding the provision of the diverting wall 85. Additionally, because the channel 82 through the vent 81 will typically be much smaller than the opening through the outlet 79 of the nozzle housing 79, it can be expected that the redirected flow will forcibly spray from the air inlet 83. While such a redirected flow cannot be prevented, the described most preferred arrangement will at least ensure that the flow is nominally directed toward the open top 16 of a beverage cup 15 and/or the drip tray 13 rather than outward from the drink dispensing nook.

As previously noted, plain water, when used as the diluent, is generally susceptible to separation into multiple flow paths as the plain water transits a nozzle housing. Left unabated, these separate flows come back together as the beverage approaches the narrowed outlet from the nozzle housing, where the collision of the non-uniform flows causes a random "fan" and "twist" effect. Rather than flowing from the nozzle housing in a consistent column shape, the dispensed beverage can splash syrups and other fluids on the user, as opposed to being restricted to flowing through the open top 16 of a beverage cup 15 or into a drip tray 13 of the drink dispensing system 10. With this deficiency of the prior art in mind, and referring now to FIGS. 18-26, a second preferred embodiment of the post-mix drink dispenser 11 of the present invention is shown to include a nozzle housing 87 adapted to dependently support a selectively integral diffuser 99. As will be appreciated by those of ordinary skill in the art in light of this exemplary description, the selectively integral diffuser 99 allows the flow stream to form a relatively larger number of individual uniform flows, which exit the outlet 79 from the nozzle housing 87 at substantially the same time. Applicant has found that the resultant smaller streams do not cause the undesired fanning and/or twisting effects, and readily and evenly mess together with concentrates and/or additives in the formation of a dispensed beverage.

Figure 18:
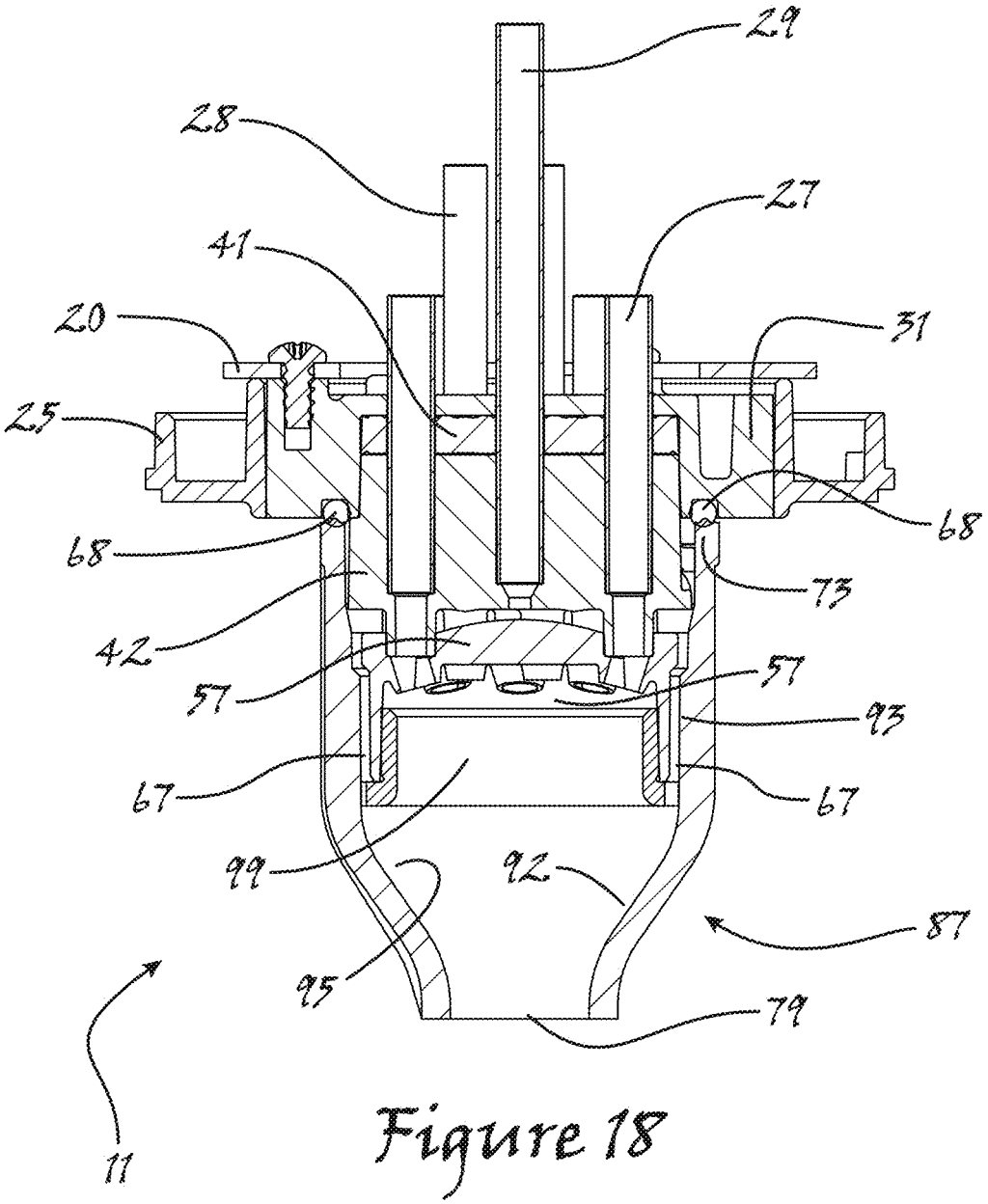
FIG. 18 is a cross-sectional elevational view (generally corresponding to the view of FIG. 14) illustrating the nozzle housing with removable diffuser of the post-mix drink dispenser according to a second embodiment.
Figure 19:
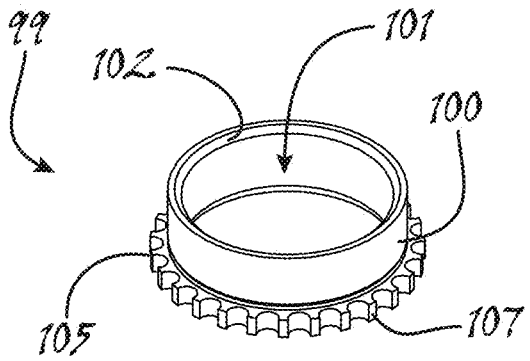
FIG. 19 is a top isometric view illustrating the removable diffuser of the post-mix drink dispenser according to the second embodiment.
Figure 20:
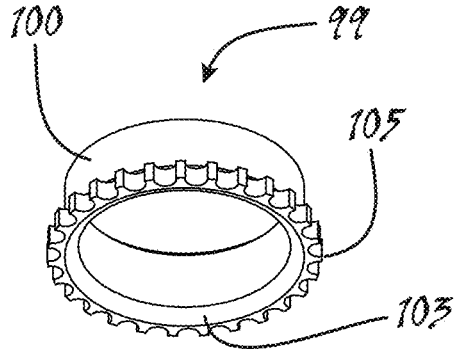
FIG. 20 is a bottom isometric view illustrating the removable diffuser of the post-mix drink dispenser according to the second embodiment.
Figure 21:
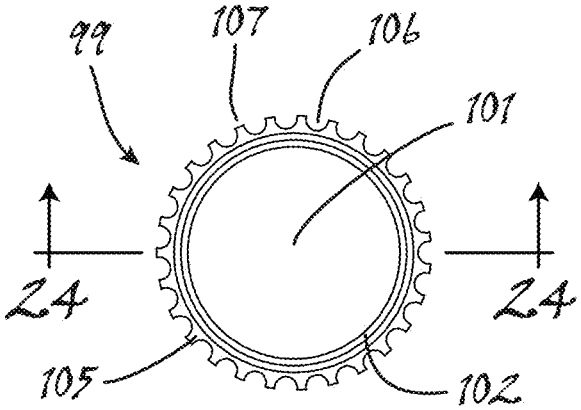
FIG. 21 is a top plan view illustrating the removable diffuser of the post-mix drink dispenser according to the second embodiment.
Figure 22:
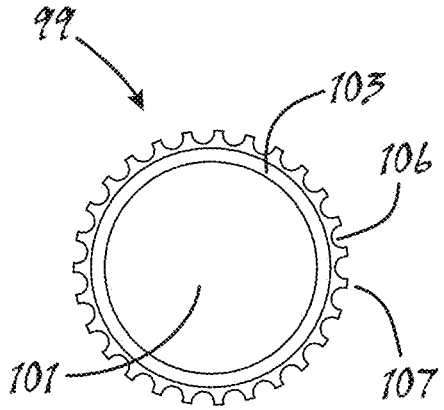
FIG. 22 is a bottom plan view illustrating the removable diffuser of the post-mix drink dispenser according to the second embodiment.
Figure 23:
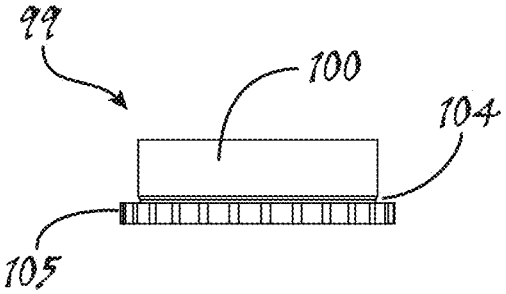
FIG. 23 is an elevational view illustrating the removable diffuser of the post-mix drink dispenser according to the second embodiment.
Figure 24:
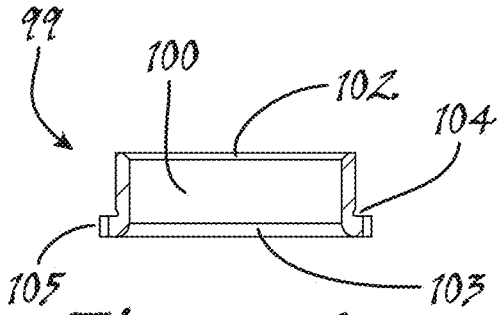
FIG. 24 is a cross-sectional elevational view taken along lines 24-24 of FIG. 21 illustrating the removable diffuser of the post-mix drink dispenser according to the second embodiment.
Figure 25:
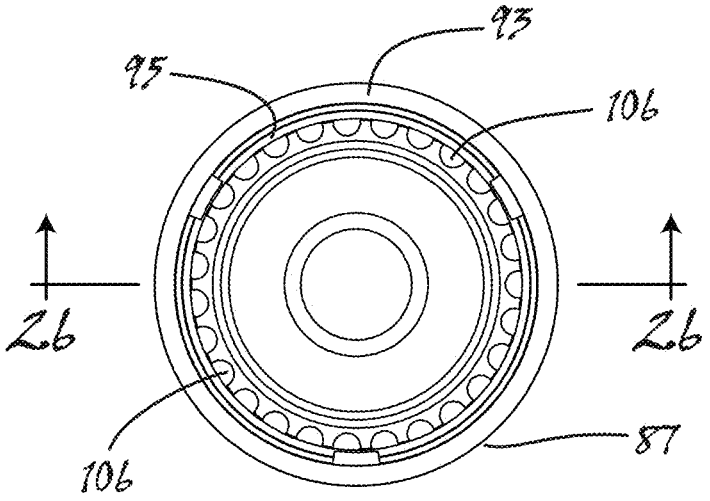
FIG. 25 is a top plan view illustrating the removable diffuser, as operably positioned within the nozzle housing, of the post-mix drink dispenser according to the second embodiment.
Figure 26:
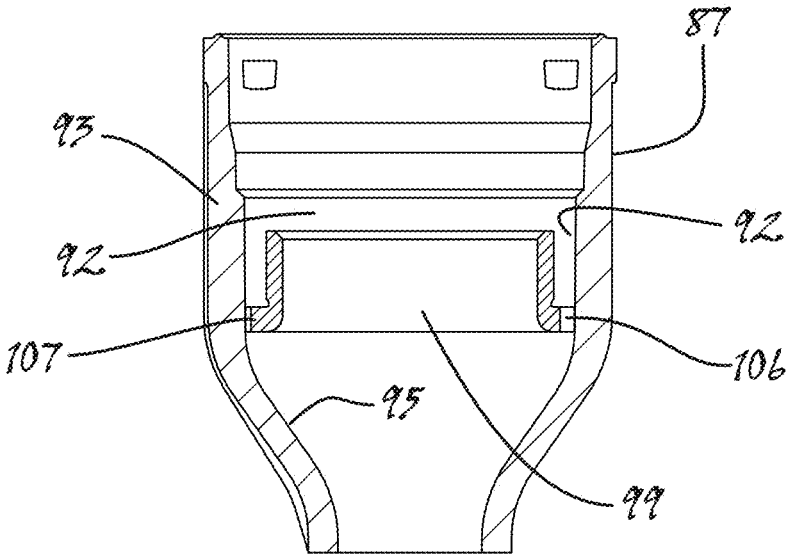
FIG. 26 is a cross-sectional elevational view taken along lines 26-26 of FIG. 25 illustrating the removable diffuser, as operably positioned within the nozzle housing, of the post-mix drink dispenser according to the second embodiment.
Figure 27:
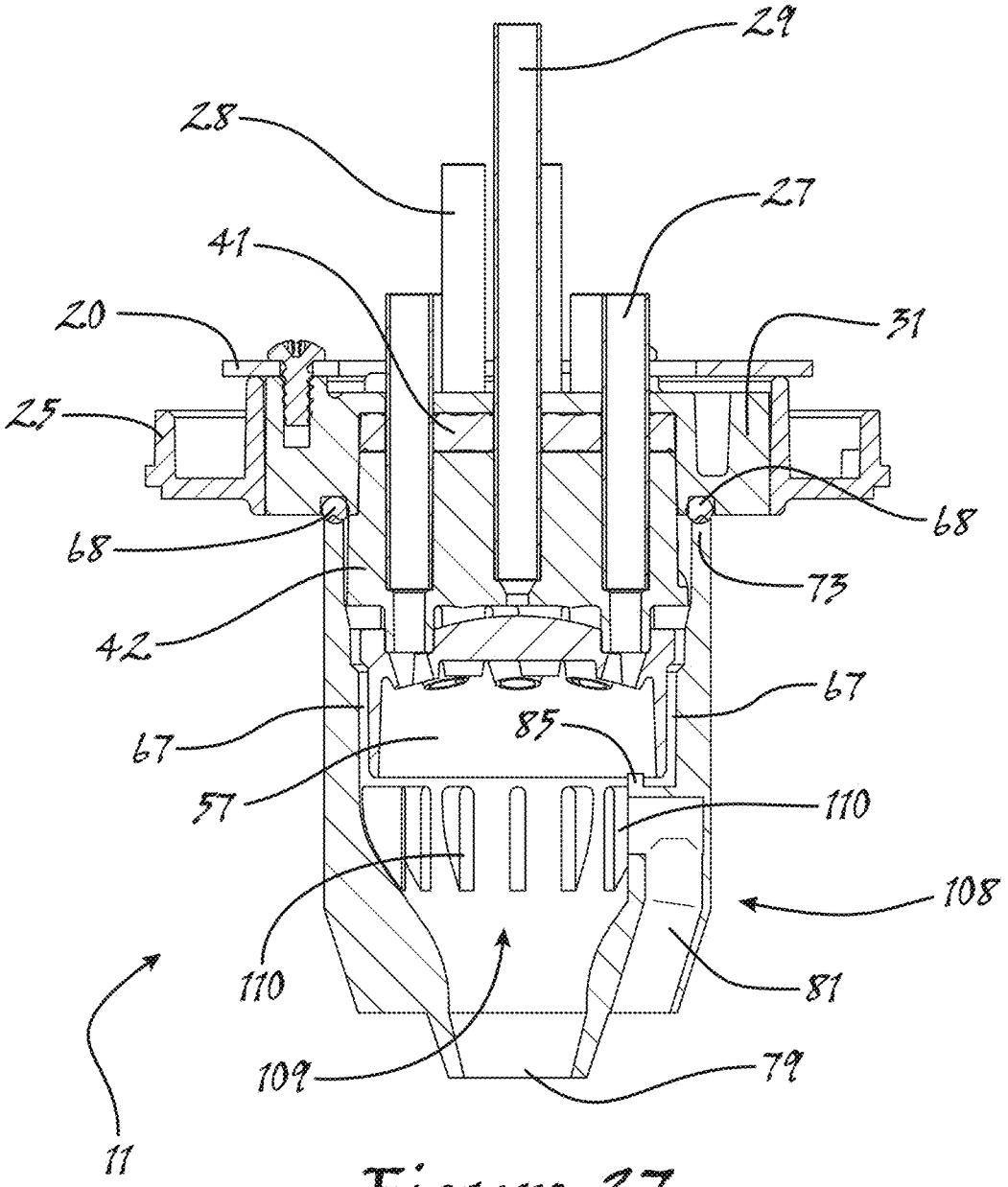
FIG. 27 is a cross-sectional elevational view (generally corresponding to the views of FIGS. 14 and 18) illustrating the nozzle housing, with unitary diffuser and unitary vent, of the post-mix drink dispenser according to the third embodiment.
Figure 30:
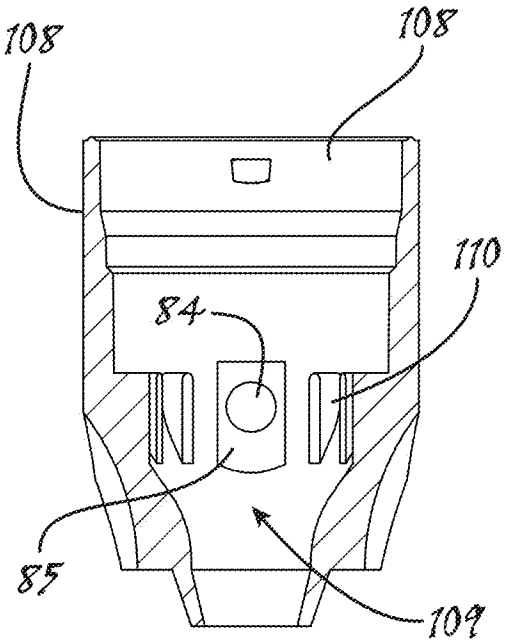
FIG. 30 is a cross-sectional elevational view taken along lines 30-30 of FIG. 28 illustrating the nozzle housing, with unitary diffuser and unitary vent, of the post-mix drink dispenser according to the third embodiment.
Figure 29:
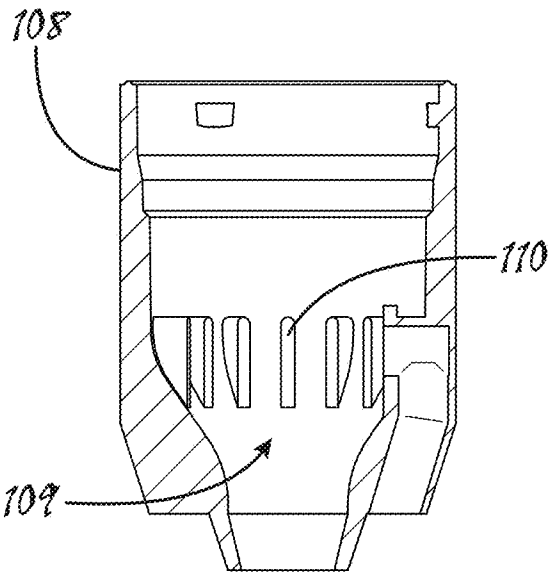
FIG. 29 is a cross-sectional elevational view taken along lines 29-29 of FIG. 28 illustrating the nozzle housing, with unitary diffuser and unitary vent, of the post-mix drink dispenser according to the third embodiment.
Figure 28:
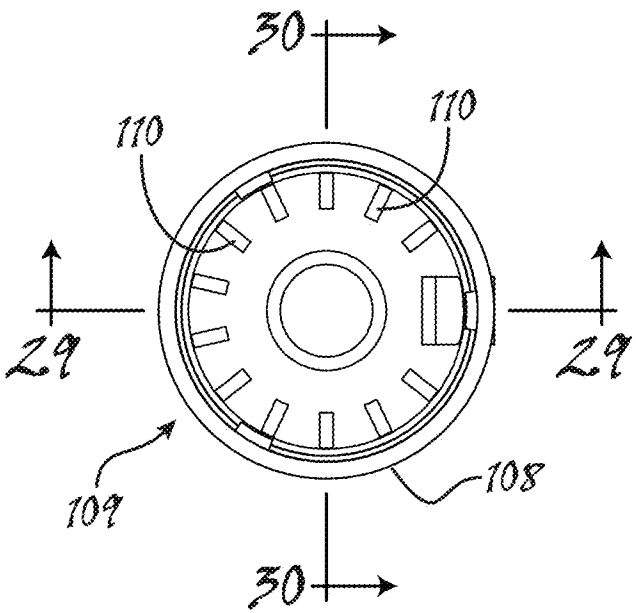
FIG. 28 is a top plan view illustrating the nozzle housing, with unitary diffuser and unitary vent, of the post-mix drink dispenser according to the third embodiment.

As shown in FIG. 18, the selectively integral diffuser 99 according to the second preferred embodiment of the post-mix drink dispenser 11 of the present invention is sized, shaped and otherwise adapted to be dependently supported by a transition of the inner surface 92 of the nozzle housing 87 between a substantially cylindrical upper portion 93 and a tapered lower portion 95. Likewise, the selectively integral diffuser 99 is sized, shaped and otherwise adapted such that much of its structure is received within the extents of the cylindrical cavity 65 of the stage three body 57 of the mixer 30. Although those of ordinary skill in the art will recognize, in light of this exemplary description, that other implementations are possible, the presently described most preferred compact implementation has at least the advantage of being readily amenable to integration with the universal aspects of the post-mix drink dispenser 11 of the present invention. To be sure, it should be noted that the presently described features of the selectively integral diffuser 99 according to the second preferred embodiment of the post-mix drink dispenser 11 are readily combinable with the nozzle housing 69 with unitary vent 81 according to the first preferred embodiment of the post-mix drink dispenser 11, and any such combination should be considered within the scope of the present invention.

In any case, the selectively integral diffuser 99 according to the second preferred embodiment of the post-mix drink dispenser 11 is particularly shown in FIGS. 19-24 to generally comprise an annular wall 100 having a circumferential foot 105 formed at the bottom thereof. The annular wall 100 is formed to have an outer diameter closely conforming to the diameter of the cylindrical cavity 65 of the stage three body 57 of the mixer 30, which operates to center selectively integral diffuser 99 in place between the nozzle housing 69 and the mixer 30. The height of the annular wall 100, however, should be sufficiently limited to prevent contact of the annular wall 100 with any of the directional nozzles 66 of the stage three body 57 of the mixer 30.

A central orifice 101 defined by the interior surface of the annular wall 100 allows unimpeded passage of concentrates and additives flowing from the directional nozzles 66 of the stage three body 57 of the mixer 30. To this end, annular wall 100 is formed to have a minimum structurally sound thickness, thereby reducing the possibility that a concentrate or additive flowing from a directional nozzle 66 of the stage three body 57 of the mixer 30 will inadvertently come into contact with the selective integral diffuser 99. Further reducing this possibility, the annular wall 100 includes an interiorly chamfered top edge 102. To minimize the effect of any such contact, however, the annular wall 100 also includes an interiorly filleted bottom edge 103, which serves to prevent drip collection.

As noted above, the nozzle housing 87 and selectively integral diffuser 99 are cooperatively adapted such that the nozzle housing 87 dependently supports the selectively integral diffuser 99 as centered operatively in place within the cylindrical cavity 65 of the stage three body 57 of the mixer 30. To this end, the height and diameter of the circumferential foot 105 about the base of the annular wall 100 are selected such that the circumferential foot 105 wedges in place within, and adjacent the inner surface 92 of, the nozzle housing 87 where the inner surface 92 of the nozzle housing 87 transitions from the substantially cylindrical upper portion 93 to the tapered lower portion 95, as particularly shown in FIGS. 25-26.

In order to provide the desired diffusing effect, a plurality of semicircular flow passages 106 are provided through and about the circumferential foot 105 of the selectively integral diffuser 99. As shown in the figures, and in FIG. 25 in particular, the semicircular shape of the flow passages 106 maximizes the flow area along the inner surface 92 of the nozzle housing 87. Although the ribs 107 between semicircular flow passages 106 must be of sufficient thickness to enable consistent manufacturability, it is desirable to otherwise maximize the flow area through the flow passages 106. To this end, and, in addition to carefully balancing the radius of the flow passages 106 with the thickness of the ribs 107, the most preferred implementation of the selectively integral diffuser 99 includes an undercut 104 about the lower exterior of the annular wall 100, as most clearly shown in FIGS. 23-24. As will be appreciated by those of ordinary skill in the art in light of this exemplary description, the undercut 104 enables greater area for each of the semicircular flow passages 106.

In use of the second preferred embodiment of the post-mix drink dispenser 11, the selectively integral diffuser 99 is placed with the nozzle housing 87, as previously described, prior to attachment of the nozzle housing 87 to the mixer 30. Once prepared, however, the nozzle housing 87 with placed selectively integral diffuser 99 is coupled to the mixer 30, as previously described. Setup of the drink dispensing system 10 and operation by a user to dispense a beverage also follows the steps previously described. On the other hand, as the selected diluent flows around the stage three body 57 and through the annular diluents passage 67, the diluent will be separated into multiple flow paths by the semicircular flow passages 106. This separation causes uniform contact between the diluent and the inner surface 92 of the nozzle housing 87 as the diluent is discharged from the mixer 30, and accordingly facilitates a uniform, stable, and consistent flow of mixed diluent and concentrate and/or additive through the post-mix drink dispenser 11. As an additional benefit, however, it is noted that Applicant has found that the smaller individual semicircular flow passages 106 each create an individual surface tension barrier. Together, sufficient surface tension is created to retain any residual diluent at the stage three body 57 of the mixer 30, thereby also contributing to drip reduction.

Although the described second preferred embodiment of the post-mix drink dispenser 11, including a selectively integral diffuser 99, presents the advantage of being able to replace the selectively integral diffuser 99 with another having, for example, a different pattern or size configuration of flow passages, and also the advantage of being selectively combinable with the first preferred embodiment of the post-mix drink dispenser 11, it is also noted that the features of the first preferred embodiment of the post-mix drink dispenser 11 may be unitarily combined with the features of the second preferred embodiment of the post-mix drink dispenser 11. As shown in FIGS. 27-30, a third preferred embodiment of the post-mix drink dispenser 11 including a nozzle housing 108 comprising a unitary vent 81, as previously described, may be provided with a unitary diffuser 109. The provision of such a unitary diffuser 109 has the advantage of being less likely lost or misplaced during, for example, cleaning. As shown in the figures, such a unitary diffuser 109 may, for example, comprise a plurality of vertically oriented fins 110 disposed radially about the lower interior surface of the nozzle housing. It is noted, however, that the number of such fins 110 provided must be selected to produce the desired flow uniformity. In making the selection, it is further noted that too many fins 110 will result in restricted flow while too few fins 110 may create clumping in the flow.

Finally, those of ordinary skill in the art will also recognize in light of this exemplary description that such a nozzle housing 108 comprising a unitary diffuser 109 may also be utilized without inclusion of a unitary vent 81. That said, any combination of the various features of the described preferred embodiments is, and should be considered to be, within the scope of the present invention.

What is claimed is:

1. A post-mix drink dispenser, said post-mix drink dispenser comprising:

a mixer body securable to a drink dispensing system, said mixer body having a bottom, a lower sidewall adjacent said bottom, at least one beverage concentrate inlet, and, for each provided beverage concentrate inlet, a corresponding beverage concentrate outlet;

wherein each said beverage concentrate outlet is sheltered within a downwardly open cavity formed in said bottom of said mixer body and bounded by an interior portion of said lower sidewall of said mixer body;

a diluent pathway running through a diluent channel formed exterior to said cavity about said lower sidewall of said mixer body;

a nozzle housing securable in place about said mixer body, said nozzle housing comprising a walled body having a substantially open interior wherein a top edge of said nozzle housing defines an inlet at the top of said nozzle housing and an outlet is formed at the bottom of said nozzle housing, said nozzle housing being adapted to coalesce beverage components flowing from said mixer body and diluent flowing about said mixer body and direct the coalesced beverage components and diluent through said outlet of said nozzle housing; and a vent formed in a wall portion of said nozzle housing, said vent being adapted to provide air from without said nozzle housing to said cavity in said bottom of said mixer body, said vent comprising an air channel through said wall portion having an air inlet and an air outlet, said air outlet projecting from said wall portion to terminate at a location within an interior space of said nozzle housing that is within the horizontal extents of said interior portion of said lower sidewall of said mixer body such that said air outlet prevents an ingress of coalesced beverage components and diluent to said vent as coalesced beverage components and diluent flow through said outlet of said nozzle housing.

2. The post-mix drink dispenser as recited in claim 1, wherein each beverage concentrate outlet comprises a beverage concentrate nozzle.

3. The post-mix drink dispenser as recited in claim 2, wherein each said beverage concentrate nozzle is directional.

4. The post-mix drink dispenser as recited in claim 1, wherein said mixer body has a plurality of beverage concentrate inlets.

5. The post-mix drink dispenser as recited in claim 1, wherein said mixer body has at least one beverage additive inlet, and, for each provided beverage additive inlet, a corresponding beverage additive outlet.

6. The post-mix drink dispenser as recited in claim 5, wherein each beverage additive outlet comprises a beverage additive nozzle.

7. The post-mix drink dispenser as recited in claim 6, wherein each said beverage additive nozzle is directional.

8. The post-mix drink dispenser as recited in claim 1, wherein said mixer body and said nozzle housing are cooperatively adapted to form said diluent channel.

9. The post-mix drink dispenser as recited in claim 1, wherein:

said mixer body has at least one diluent inlet and a diluent outlet in fluid communication with each provided diluent inlet; and said diluent outlet runs into said diluent channel.

10. The post-mix drink dispenser as recited in claim 9, wherein said mixer body and said nozzle housing are cooperatively adapted to form said diluent channel.

11. The post-mix drink dispenser as recited in claim 1, wherein said mixer body is formed as a multi-body assembly.

12. The post-mix drink dispenser as recited in claim 1, wherein said nozzle housing is securable to said mixer body.

13. The post-mix drink dispenser as recited in claim 1, wherein said air channel comprises a wall formed about said air outlet that diverts diluent flowing from the diluent pathway about said vent thereby preventing an ingress of coalesced beverage components and diluent to said vent as coalesced beverage components and diluent flow through said outlet of said nozzle housing.

14. The post-mix drink dispenser as recited in claim 1, wherein said air channel is adapted to contain flow through said vent of liquid beverage components when said outlet of said nozzle becomes partially or fully occluded.

15. The post-mix drink dispenser as recited in claim 14, wherein said air inlet is located at the bottom of said nozzle housing adjacent said outlet of said nozzle housing.

16. The post-mix drink dispenser as recited in claim 15, wherein said air channel comprises a wall formed about said air outlet that diverts diluent flowing from the diluent pathway about said vent thereby preventing an ingress of coalesced beverage components and diluent to said vent as coalesced beverage components and diluent flow through said outlet of said nozzle housing.

17. The post-mix drink dispenser as recited in claim 15, wherein said air inlet is oriented to direct any liquid beverage component flowing out of said inlet downward and toward a central vertical axis running through said outlet of said nozzle housing when said outlet of said nozzle becomes partially or fully occluded.

18. The post-mix drink dispenser as recited in claim 17, wherein said air channel comprises a wall formed about said air outlet that diverts diluent flowing from the diluent pathway about said vent thereby preventing an ingress of coalesced beverage components and diluent to said vent as coalesced beverage components and diluent flow through said outlet of said nozzle housing.

19. The post-mix drink dispenser as recited in claim 1, said post-mix drink dispenser further comprising a diffuser adapted to organize flows of diluent along the interior surface of said nozzle housing into multiple substantially uniform individual flows.

20. The post-mix drink dispenser as recited in claim 19, wherein said air channel comprises a wall formed about said air outlet that diverts diluent flowing from the diluent pathway about said vent thereby preventing an ingress of coalesced beverage components and diluent to said vent as coalesced beverage components and diluent flow through said outlet of said nozzle housing.

21. The post-mix drink dispenser as recited in claim 19, wherein said air channel is adapted to contain flow through said vent of liquid beverage components when said outlet of said nozzle becomes partially or fully occluded.

22. The post-mix drink dispenser as recited in claim 21, wherein said air inlet is located at the bottom of said nozzle housing adjacent said outlet of said nozzle housing.

23. The post-mix drink dispenser as recited in claim 22, wherein said air channel comprises a wall formed about said air outlet that diverts diluent flowing from the diluent pathway about said vent thereby preventing an ingress of coalesced beverage components and diluent to said vent as coalesced beverage components and diluent flow through said outlet of said nozzle housing.

24. The post-mix drink dispenser as recited in claim 22, wherein said air inlet is oriented to direct any liquid beverage component flowing out of said inlet downward and toward a central vertical axis running through said outlet of said nozzle housing when said outlet of said nozzle becomes partially or fully occluded.

25. The post-mix drink dispenser as recited in claim 24, wherein said air channel comprises a wall formed about said air outlet that diverts diluent flowing from the diluent pathway about said vent thereby preventing an ingress of coalesced beverage components and diluent to said vent as coalesced beverage components and diluent flow through said outlet of said nozzle housing.

26. The post-mix drink dispenser as recited in claim 19, wherein said diffuser is formed unitary with said nozzle housing.

27. The post-mix drink dispenser as recited in claim 26, wherein said diffuser comprises a plurality of fins disposed radially about the interior surface of said nozzle housing.

28. The post-mix drink dispenser as recited in claim 27, wherein each said fin is vertically oriented.

29. The post-mix drink dispenser as recited in claim 19, wherein said diffuser is selectively removable from said post-mix drink dispenser.

30. The post-mix drink dispenser as recited in claim 29, wherein said diffuser is dependently supported in place with respect to said mixer body by said nozzle housing.

31. The post-mix drink dispenser as recited in claim 29, wherein said diffuser comprises:

an annular wall having an inner surface defining a central orifice, an outer surface, a top edge, and a bottom edge;

a circumferential foot about said outer surface of said annular wall adjacent said bottom edge of said annular wall; and a plurality of flow passages provided through and about said circumferential foot.

32. The post-mix drink dispenser as recited in claim 31, wherein said top edge of said annular wall is interiorly chamfered.

33. The post-mix drink dispenser as recited in claim 31, wherein said bottom edge of said annular wall is interiorly filleted.

34. The post-mix drink dispenser as recited in claim 31, wherein each said flow passage through said circumferential foot has a semicircular cross section.

35. The post-mix drink dispenser as recited in claim 34, wherein said outer face of said annular wall is undercut adjacent said circumferential foot.

36. The post-mix drink dispenser as recited in claim 31, wherein said interior portion of said lower sidewall of said mixer body is sized and shaped to fit conformingly over and about said outer surface of said annular wall of said diffuser.

37. The post-mix drink dispenser as recited in claim 36, wherein said diffuser is dependently supported in place with respect to said mixer body by said nozzle housing.

38. The post-mix drink dispenser as recited in claim 37, wherein:

the inner surface of said nozzle housing comprises a transition between a substantially cylindrical upper portion and a tapered lower portion;

the size and shape of the inner surface of said nozzle housing at said transition is sized and shaped to dependently support said circumferential foot about said outer surface of said annular wall of said diffuser; and said transition in shape of the inner surface of said nozzle housing is located such that said flow passages through said circumferential foot are positioned below and adjacent the lower end of said diluent channel.

39. A post-mix drink dispenser, said post-mix drink dispenser comprising:

a mixer body securable to a drink dispensing system, said mixer body having a bottom, a lower sidewall adjacent said bottom, at least one beverage concentrate inlet, and, for each provided beverage concentrate inlet, a corresponding beverage concentrate outlet;

a nozzle housing securable in place about said mixer body, said nozzle housing comprising a walled body having a substantially open interior wherein a top edge of said walled body defines an inlet through the top of the nozzle housing and an outlet from the nozzle housing is formed at the bottom of said walled body; and a vent formed in a wall portion of said nozzle housing, said vent being adapted to provide air from without said nozzle housing to a cavity formed in the bottom of said mixer body, said vent comprising an air channel through said wall portion having an air inlet and an air outlet, said air outlet projecting from said wall portion to terminate at a location within an interior space of said nozzle housing that is within the horizontal extents of said interior portion of said lower sidewall of said mixer body such that said air outlet prevents an ingress of coalesced beverage components and diluent to said vent as coalesced beverage components and diluent flow through said outlet of said nozzle housing.

40. The post-mix drink dispenser as recited in claim 39, wherein said air channel comprises a wall formed about said air outlet that diverts diluent flowing from the diluent pathway about said vent thereby preventing an ingress of coalesced beverage components and diluent to said vent as coalesced beverage components and diluent flow through said outlet of said nozzle housing.

41. The post-mix drink dispenser as recited in claim 39, wherein said air inlet is located at the bottom of said nozzle housing adjacent said outlet of said nozzle housing.

42. The post-mix drink dispenser as recited in claim 41, wherein said air channel comprises a wall formed about said air outlet that diverts diluent flowing from the diluent pathway about said vent thereby preventing an ingress of coalesced beverage components and diluent to said vent as coalesced beverage components and diluent flow through said outlet of said nozzle housing.

43. The post-mix drink dispenser as recited in claim 41, wherein said air inlet is oriented downward and toward a central vertical axis running through said outlet of said nozzle housing.

44. The post-mix drink dispenser as recited in claim 43, wherein said air channel comprises a wall formed about said air outlet that diverts diluent flowing from the diluent pathway about said vent thereby preventing an ingress of coalesced beverage components and diluent to said vent as coalesced beverage components and diluent flow through said outlet of said nozzle housing.

45. The post-mix drink dispenser as recited in claim 39, said nozzle housing further comprising a unitary diffuser adapted to organize fluid flows along the interior surface of said nozzle housing into multiple substantially uniform individual flows.

46. The post-mix drink dispenser as recited in claim 45, wherein said diffuser comprises a plurality of fins disposed radially about the interior surface of said nozzle housing.

47. The post-mix drink dispenser as recited in claim 46, wherein each said fin is vertically oriented.

* * * * *